US011178479B2

(12) United States Patent
Thomas

(10) Patent No.: US 11,178,479 B2
(45) Date of Patent: Nov. 16, 2021

(54) BONE CONDUCTION HEADSET

(71) Applicant: Matthew Thomas, Yukon, OK (US)

(72) Inventor: Matthew Thomas, Yukon, OK (US)

( * ) Notice: Subject to any disclaimer, the term of this patent is extended or adjusted under 35 U.S.C. 154(b) by 0 days.

(21) Appl. No.: 16/902,041

(22) Filed: Jun. 15, 2020

(65) Prior Publication Data

US 2020/0396529 A1 Dec. 17, 2020

Related U.S. Application Data

(60) Provisional application No. 62/921,436, filed on Jun. 15, 2019.

(51) Int. Cl.
*H04R 25/00* (2006.01)
*H04R 1/10* (2006.01)

(52) U.S. Cl.
CPC ..... *H04R 1/105* (2013.01); *H04R 1/1066* (2013.01); *H04R 1/1091* (2013.01); *H04R 2460/13* (2013.01)

(58) Field of Classification Search
CPC combination set(s) only.
See application file for complete search history.

(56) References Cited

U.S. PATENT DOCUMENTS

| | | | | |
|---|---|---|---|---|
| 7,010,139 | B1 | 3/2006 | Smeehuyzen | |
| 7,076,077 | B2 | 7/2006 | Atsumi et al. | |
| 7,822,215 | B2 | 10/2010 | Carazo et al. | |
| 8,498,587 | B2 | 7/2013 | Boesen | |
| D839,236 | S | 1/2019 | Hardi | |
| 2001/0031062 | A1 | 10/2001 | Terai et al. | |
| 2009/0185699 | A1* | 7/2009 | Kim | H04R 1/1066 381/151 |
| 2011/0301729 | A1 | 12/2011 | Heiman et al. | |
| 2017/0318372 | A1 | 11/2017 | Gerber et al. | |

FOREIGN PATENT DOCUMENTS

| | | |
|---|---|---|
| CN | 301352460 | 9/2010 |
| CN | 304788352 | 8/2018 |
| IN | 263069-0001 | 12/2013 |
| JP | 2006229373 | 8/2006 |

(Continued)

OTHER PUBLICATIONS

The world's first 3D printed bone conduction headset launches on Indiegogo, https://www.3ders.org/articles/20141203-the-rolds-first-3d-printed-bone-conduction-headset-launches-on-indiegogo.html. Apr. 18, 2019, 15 pages.

(Continued)

*Primary Examiner* — Amir H Etesam
(74) *Attorney, Agent, or Firm* — Dunlap Codding, P.C.

(57) ABSTRACT

A headset for a head having a first earpiece, a second earpiece, and a headband. The first earpiece has a horseshoe shaped housing and a plurality of audio elements. The housing of the first earpiece has a crest. The second earpiece has a horseshoe shaped housing and a plurality of audio elements. The housing of the second earpiece has a crest. The headband extends between the crest of the first earpiece and the crest of the second earpiece. The plurality of audio elements of the first earpiece are positionable against a first side of the head and the plurality of audio elements of the second earpiece are positionable against a second side of the head.

18 Claims, 27 Drawing Sheets

(56) References Cited

FOREIGN PATENT DOCUMENTS

| | | | |
|---|---|---|---|
| JP | 2018046525 | | 3/2018 |
| KR | A200282696 | Y1 | 7/2002 |
| KR | 101771607 | B1 | 8/2017 |
| SG | U20011222G-0001 | | 3/1997 |
| WO | 2010023755 | A1 | 3/2010 |

OTHER PUBLICATIONS

Bone Conduction Intelligent Earphone Wireless Bluetooth Headphone Car Headset Ear-hook with Mic, https://www.globalsources.com/gsol/l/Bone-conduction/p/sm/1161329045.htm#1161329045. Apr. 18, 2019, 3 pages.
International Search Report and Written Opinion (PCT/US2020/037789); dated Oct. 23, 2020; 12 pages.

* cited by examiner

BONE CONDUCTION HEADSET

BACKGROUND

The use of traditional earphones and ear-buds, for listening to music and other audio content, hinders the ability of persons to detect ambient sound in their environment as they perform daily activities or take part in other pursuits such as walking, running, skiing, driving, skating, biking, or working. Because the earphones or ear-buds cover or are within a person's ear canal, it can be difficult to hear sounds such as a car driving nearby, an automobile or train's horn, sirens, or communication from other people. In addition, earphones and ear-buds often can be used at volumes that damage a person's hearing. Accordingly, headphones and ear-buds present a significant safety hazard.

A majority of hearing is through the ear drums. However, some hearing occurs through the bones in the skull and around the ears. These sounds are produced through bone conduction, or vibrations that we sense and interpret as sound. Beethoven discovered that he could hear music through his jawbone by biting on a rod attached to his piano after he had become "deaf." This allowed him to complete several works after his hearing loss. Normal sound waves are vibrations which are transferred through the air. These enter the ear canal and vibrate the ear drums which in turn decode the sound waves into different vibrations received by the Cochlea in the inner ear. The Cochlea transmits the sensed waves to the auditory nerve which transmits the sound to our brain, where it is interpreted as sound, volume and pitch frequencies. Ear drums are quite sensitive and can be damaged over time by loud volumes and continuous noise which decays our hearing, often resulting in full or partial deafness. Hearing aids are used to amplify sound and transmit the sound into the inner ear.

Bone conduction ("BC") headphones have been developed to allow a user to listen to music from a device while, at the same time, keeping the user's ear canals open. Bone conduction bypasses the eardrum. A bone conduction transducer performs the task of the eardrum, except not through the ear canal, but instead by the bones surrounding the ear. BC headphones decode sound waves and convert them into vibrations that are directly received by the Cochlea, so the ear drum is never involved. BC is not necessarily a safer way to listen, instead an alternative listening approach that allows the wearer to continue to have a level of audible continuity with the wearer's surrounding environment. This environmental continuity allows the wearer to use the headphones while doing activities that may be safer when environmental noise is heard, such as driving or during outdoor activities. The bones of the skull closest to the ear from front to back include the zygomatic process, the temporal bone and the mastoid portion of the skull.

For example, AFTERSHOKZ® headphones are a popular consumer item wherein a single pair of BC transducers is placed on other side of the user's head around the mandible bone. Headphones, like the AFTERSHOKZ® headphones, include a headband that wraps around the back of the user's head or just below the skull at the back of the neck. These types of headphones are often worn by athletes. However, placement of the headband around the back of the user's head can interfere with certain athletic activities requiring the user to place his or head on a flat surface, such as some weight lifting activities. Some user's also find the placement of the headband around the back of the head or neck uncomfortable. BC headphones, like the AFTERSHOKZ® headphones, also include only one BC transducers on each side of the user's head. Often times the volumes provided by these BC headphones is insufficient.

Therefore, a need exists for a BC headset with a comfortable and conveniently located headband and with earpieces having radial placement of more than one BC transducer on each earpiece for improved bone transmission and better conduction of vibrations emitted by the headphones to the inner ear while still keeping the user's ear canals open. It is to such a headset that the inventive concepts disclosed herein are directed.

DETAILED DESCRIPTION OF EXEMPLARY EMBODIMENTS

Figure 1:
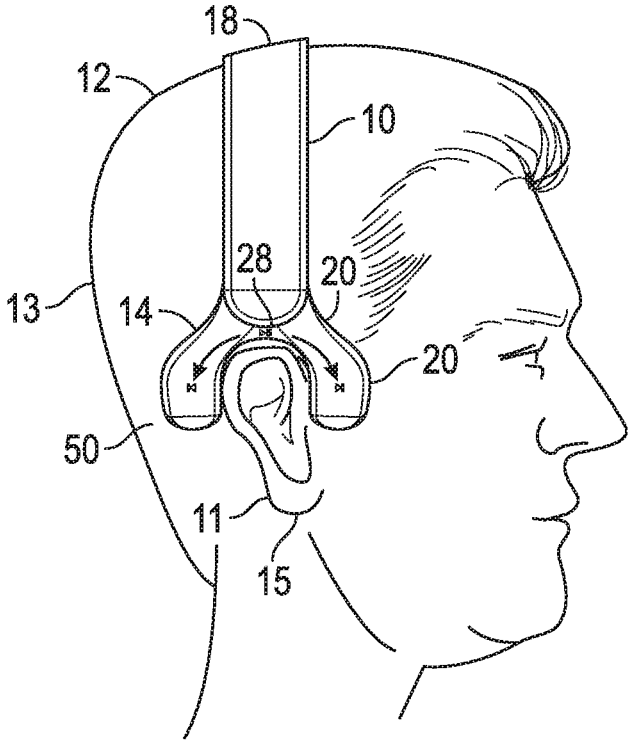
FIG. 1 is a right perspective view of a bone conduction headset shown positioned on a user's head in accordance with the inventive concepts described herein.

In the following detailed description of embodiments of the inventive concepts, numerous specific details are set forth in order to provide a more thorough understanding of the inventive concepts. However, it will be apparent to one of ordinary skill in the art that the inventive concepts disclosed and claimed herein may be practiced without these specific details. In other instances, well-known features have not been described in detail to avoid unnecessarily complicating the instant disclosure.

As used herein, the terms "comprises," "comprising," "includes," "including," "has," "having" or any other variation thereof, are intended to cover a non-exclusive inclusion. For example, a process, method, article, or apparatus that comprises a list of elements or steps is not necessarily limited to only those elements or steps and may include other elements, steps, or features not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B is true (or present).

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Throughout this disclosure and the claims, the terms "about," "approximately," and "substantially" are intended to signify that the item being qualified is not limited to the exact value specified, but includes slight variations or deviations therefrom, caused by measuring error, manufacturing tolerances, stress exerted on various parts, wear and tear, or combinations thereof, for example.

The use of the term "at least one" will be understood to include one as well as any quantity more than one, including but not limited to each of, 2, 3, 4, 5, 10, 15, 20, 30, 40, 50, 100, and all integers there between. The term "at least one" may extend up to 100 or 1000 or more, depending on the term to which it is attached; in addition, the quantities of 100/1000 are not to be considered limiting, as higher limits may also produce satisfactory results. Singular terms shall include pluralities and plural terms shall include the singular unless indicated otherwise.

The term "or combinations thereof" as used herein refers to all permutations and/or combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. The skilled artisan will understand that typically there is no limit on the number of items or terms in any combination, unless otherwise apparent from the context.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment, although the inventive concepts disclosed herein are intended to encompass all combinations and permutations including one or more features of the embodiments described herein.

Figure 2:
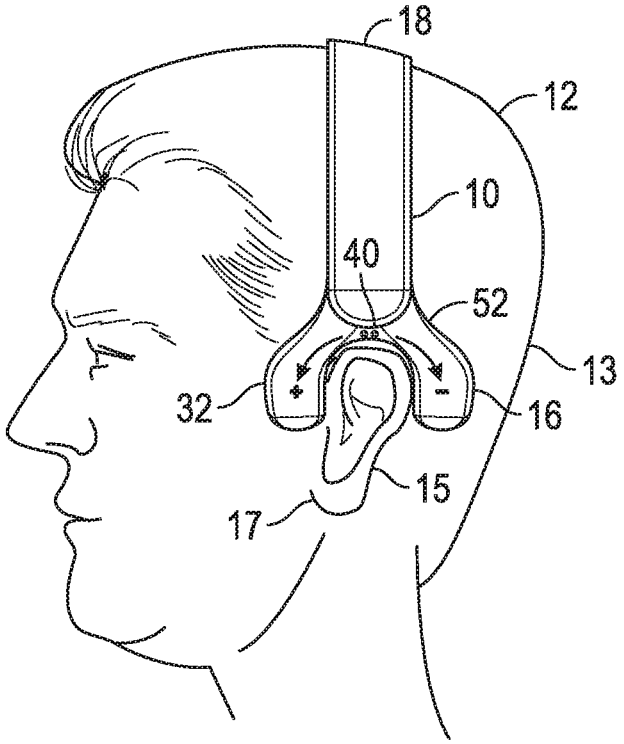
FIG. 2 is a left perspective view of the bone conduction headset shown positioned on the user's head.

Referring now to FIGS. 1-7, a headset 10 for wearing on a head of a user, such as head 12 of a user 13, is illustrated. The headset 10 may incorporate bone conduction technology for listening to audio such as, but not limited to, music, podcasts, and audio books while engaging in activities such as, but not limited to, sports and other recreation. The headset 10 includes a first earpiece 14, a second earpiece 16, and a headband 18 extending between a crest 28 of the first earpiece 14 and a crest 40 of the second earpiece 16. As shown in FIGS. 1 and 2, the headset 10 is worn by the user 13 by placing the headband 18 over the top of the head 12 and securing the earpieces 14 and 16 around a pair of ears 15 while exposing the ears 15 to the environment. It should be appreciated, however, that the headband 18 may be worn around the back of the head 12 closer to the neck. The headset 10 provides an expanded area of vibrational transfer behind and in front of the ear 15 for enhanced and expanded vibrational transfer through the bones around the ear canal and into the inner ear (aka Cochlea) for improved hearing without intrusion into the ear canal. As described below, the first earpiece 14 includes a plurality of audio elements and the second earpiece 16 includes plurality of audio elements. The plurality of audio elements of the first earpiece are positionable against a first side of the head 12 and the plurality of audio elements of the second earpiece are positionable against a second side of the head 12. It should be appreciated, however, that the headset 10 may include a single audio element on the first earpiece and a single audio element on the second earpiece 16.

Figure 5:
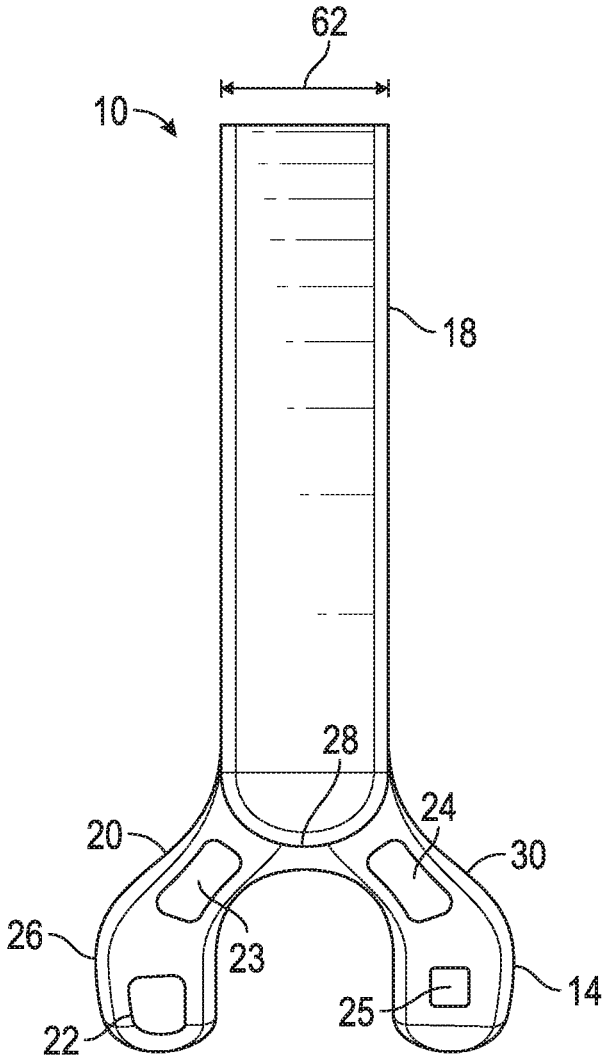
FIG. 5 is a sectional view of the bone conduction headset taken along line 5-5 of FIG. 3.

As shown in FIGS. 1 and 5, the first earpiece 14 includes a horseshoe shaped housing 20, and a plurality of audio elements such as a first audio element 22, and a second audio element 24. The housing 20 has a front portion 26, the crest 28, and a rear portion 30. The first audio element 22 is positioned on an inner surface 31 in the front portion 26 of the housing 20 and the second audio element 24 is positioned on the inner surface 31 in the rear portion 30 of the housing 20. The first audio element 22 is positionable against a first side 50 of the head 12 in front of a first ear 11 and the second audio element 24 is positionable against the first side 50 of the head 12 behind the first ear 11. In this way, the horseshoe shaped housing 20 arches over the top of the first ear 11 when the headphone set 10 is worn by the user 13 while the first ear 11 is exposed to the environment.

Figure 6:
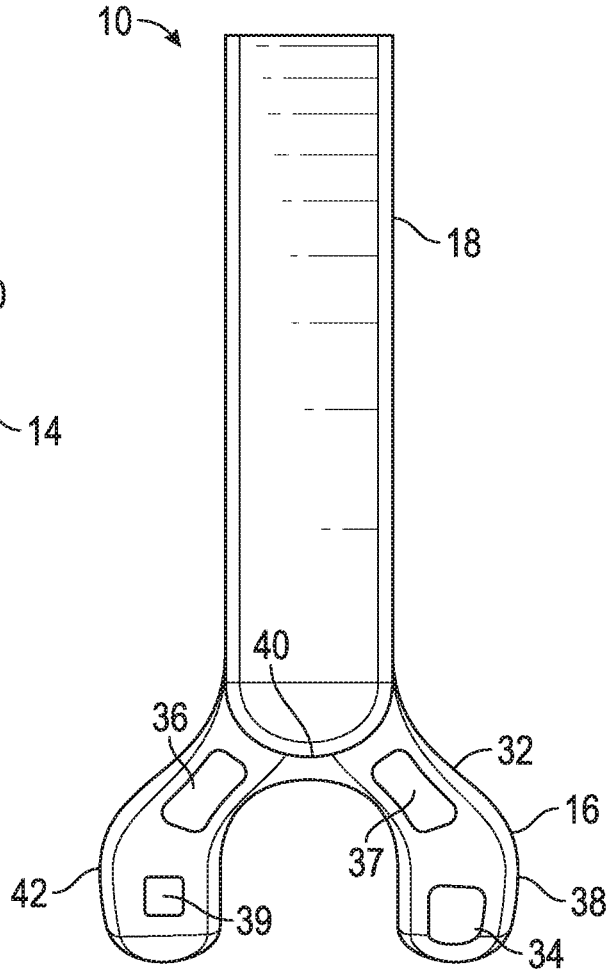
FIG. 6 is a sectional view of the bone conduction headset shown taken along line 6-6 of FIG. 6.

As shown in FIGS. 2 and 6, the second earpiece 16 includes a horseshoe shaped housing 32, and a plurality of audio elements such as a third audio element 34, and a fourth audio element 36. The housing 32 has a front portion 38, a crest 40, and a rear portion 42. The third audio element 34 is positioned on an inner surface 33 in the front portion 38 of the housing 32 and the fourth audio element 36 is on the inner surface 33 positioned in the rear portion 42 of the housing 32. The third audio element 34 is positionable against a second side 52 of the user's head 12 in front of a second ear 17, and the fourth audio element 36 is positionable against the second side 52 of the user's head 12 behind the second ear 17. The headband 18 extends between the crest 28 of the first earpiece and the crest 40 of the second earpiece. In this way, the headband 18 fits on the top of the user's head 12 and does not obstruct the user from placing his or her head on flat surfaces—as would be the case of the headband 18 was positioned about the back of the user's head 12 or neck.

In use, the first and third audio elements 22 and 34 may press against a region located near the temporal mandibular joint on either side 50 and 52 of the user's head 12 while the second and fourth audio elements 24 and 36 press against a region located near a temporal region and below a parietal region behind the ears 11 and 17, respectively. The multiple audio elements and placement in front of and behind the ears 11 and 17 may increase the volume of the headset 10 while still allowing for the ears 11 and 17 to be exposed to the environment. The first, second, third, and fourth audio elements 22/24/34/36 may convert sound produced from the headset 10 and deliver the sound as physical vibrations to tissue surrounding the ears 15 and into the zygomatic process in front of each ear, all the way around the ears 15 against the skull or temporal regions and terminating near the mastoid process behind the ears 15. The audio elements may contemporaneously pass the vibration into the contact bones of the skull into the Cochlea by uniform condition, which further pass through the inner ear to the brain, where the vibrations are interpreted into sound.

In some embodiments, the headset 10 may include a fifth audio element 23 positioned on the front portion 26 of the first earpiece 14 and a sixth audio element 25 positioned on the rear portion 30 of the first earpiece 14. The headset 110 may further include a seventh audio element 37 on the front portion 38 of the second earpiece 16 and an eighth audio element 39 on the rear portion 42 of the second earpiece 16.

As vibrations pass through tissue and bone, and then to the inner ear, some sound may pass into the external acoustic meatus. Although the skull is comprised of many more bones than discussed here, it may be desirable to reduce the length of path from an audio element to the inner ear. The headset 10 may provide a greater range of proximal vibrational transfer to the bones of the skull of the head 12 of the user 13 into the inner ear by radially placing two or more audio elements on the housing 32. The audio elements 22/23/24/25/34/36/37/39 may convert sound to vibration and transfer the vibration through the bones around the skull directly into the inner ear. A radial distribution of vibrational forces from the audio elements 22/23/24/25/34/36 on multiple locations on the bones surrounding the ear 15 on both sides of the head 12 may promote more vibrational transfer points and expanded sound—particularly where the audio elements 22/24/34/36 are able to distribute a greater variety of sounds within the audible spectrum.

The horseshoe shaped housings 20 and 32 may be of a variety of materials and sizes. For example, the housings 20 and 32 may be comprised of, but are not limited to being comprised of a single material or a combination of materials including, but not limited to, polyvinyl chloride ("PVC"), polylactic acid ("PVA"), aluminum and other metals, wood, and/or other suitable materials known in the art. One having ordinary skill in the art should appreciate that the size of the housings 20 and 32 may substantially correspond to the average size of a human ear and that different sizes of housings may be available. For example, the housings 20 and 32 may be, but are not limited to being, between about 50.0 and 90.0 mm tall. For example, but not by way of limitation, in one embodiment, the housings 20.0 and 32.0 are about 70.0 mm tall. The housings 20 and 32 may be, but are not limited to being, between about 60.0 and 100.0 mm wide. For example, but not by way of limitation, in one embodiment, the housings 20 and 32 are about 81.0 mm wide. The housings 20 and 32 may also be, but are not limited to being, between about 15.0 and about 25.0 mm thick.

The first audio element 22 and the third audio 34 element may be any bone conduction transducer known in the art suitable for a headset. For example, the first audio element 22 and the third audio element 34 may be, but are not limited to being, an ADAFRUIT® transducer. The first and third audio elements 22 and 34 may be, but are not limited to being, between about 15.0 mm and about 30.0 mm long and between about 10.0 mm and about 20.0 mm wide. For example, but not by way of limitation, in one embodiment, the first and third audio elements 22 and 34 are about 21.0 mm long and about 13.0 mm wide. The first and third audio elements 22 and 34 may have, but are not limited to having, between about 6.0 and about 10.0 ohm impedance. For example, but not by way of limitation, in one embodiment, the first and third audio elements 22 and 24 have about an 8.0 ohm impedance. The first and third audio elements 22 and 34 may be run, but are not limited to being run, between about 0.5 and 2.0 watts. For example, but not by way of limitation, in one embodiment, the first and third audio elements 22 and 34 are run at about 1.0 watts.

The second and fourth audio elements 24 and 36 may also be any known BC transducer known in the art suitable for use in a headset. The second and fourth audio elements 24 and 36 may be, but are not limited to being, between about 15.0 mm and about 30.0 mm long and between about 10.0 mm and about 20.0 mm wide. In one embodiment, the second and fourth audio elements 24 and 36 are about 21.0 mm long and about 13.0 mm wide. The second and fourth audio elements 24 and 36 may have, but are not limited to having, between about 6.0 and about 10.0 ohm impedance. In one embodiment, the second and fourth audio elements 24 and 36 have about 8.0 ohm impedance. The second and fourth audio elements 24 and 36 may be run, but are not limited to being run, between about 0.5 and about 2.0 watts. For example, but not by way of limitation, in one embodiment, the second and fourth audio elements 24 and 36 are run at about 1.0 watts. In a headset embodiment including the fifth audio element 23, the sixth audio element 25, the seventh audio element 37, and the eighth audio element 39—the fifth, sixth, seventh, and eighth audio elements 23/25/37/39 may be constructed substantially similar to the audio elements 22/23/24/25/34/36.

Figure 4:
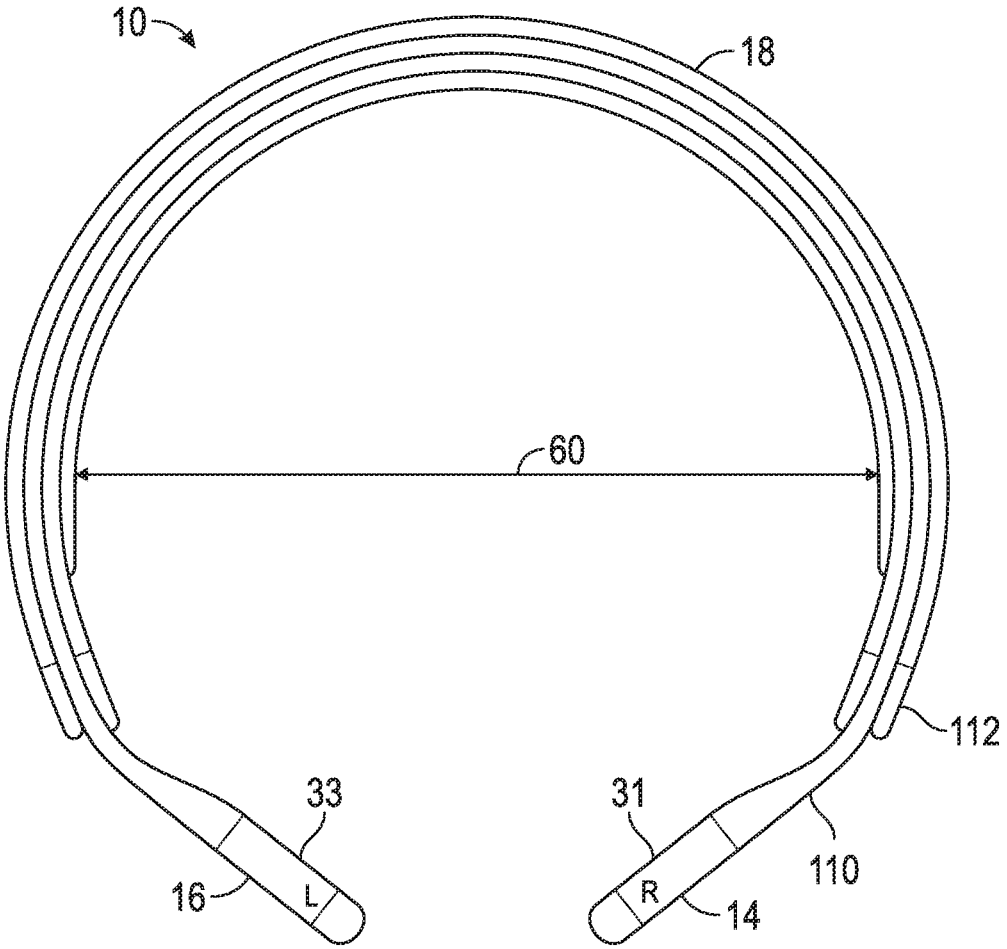
FIG. 4 is a rear elevation view of the bone conduction headset.

The headband 18 may be formed of a variety of materials and sizes. One having ordinary skill in the art should appreciate that the headband 18 may substantially conform to the size and shape of an average human head. As shown in FIGS. 4 and 5, the headband 18 may have a first width 60 and a second width 62. The first width 60 may be, but is not limited to being between about 100.0 and about 200.0 mm. For example, but not by way of limitation, in one embodiment, the first width is about 150.0 mm. The second width 62 may be, but is not limited to being, between about 20.0 and 30.0 mm. For example, but not by way of limitation, in one embodiment, the second width 62 is about 25.4 mm. One having ordinary skill in the art should appreciate that the height of the headband may be adjustable and may substantially confirm to the ordinary size of a human head. The headband 18 may be formed from a variety of materials including, but not limited to PVC, Acrylonitrile butadiene styrene ("ABS"), metals such as, but not limited to, titanium and alloy, and/or cushioning materials including, but not limited to, leather, foam, rubber, silicone, or polyurethane.

The headset 10 may be configured so that audio powers off when the user 13 removes the headband 18 from the head 12 of the user and so that the headset 10 powers on when the user 12 places the headband on the head 12. The headband 18 may be bendable. In an embodiment where the headband 18 is bendable, the functions of the headset 10 may power off when the headband 18 is in a bent position, and the functions of the headset 10 may power on when the headband 18 is in a wearing position.

Figure 3:
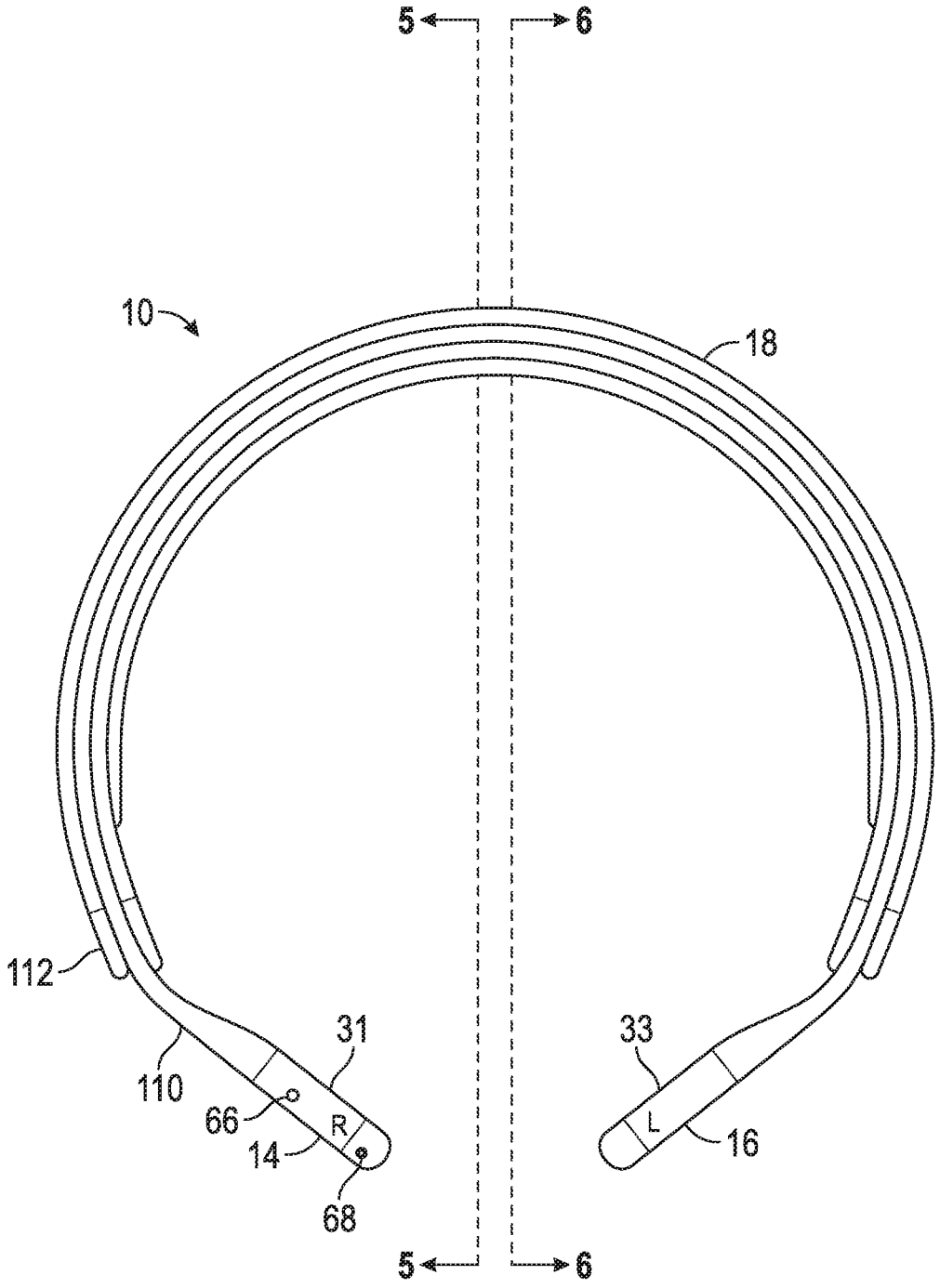
FIG. 3 is a front elevation view of the bone conduction headset.

The headset 10 may include a variety of additional features including, but not limited to, Bluetooth technology connectivity for listening to audio on a remote device and talking to third parties using a remote mobile phone A Bluetooth receiver may be incorporated into the headset 10 for transmitting and receiving two-way audio and control functions. For example, as shown in FIG. 3, the first earpiece 14 may include a power feature 66 for powering the headset on and off and pairing with a remote device by Bluetooth technology. The first earpiece 14 may also include a mic 68 for use with a remote mobile phone. One having ordinary skill in the art should appreciate that the power feature 66 and the mic 68 may be positioned on various places on the headset 10 including, but not limited to, the second earpiece 16 or the headband 18. Audio may be received as digital signals, which may be converted to physical vibrations by an audio element before passing onto a contact surface of the user 13. The audio elements may contemporaneously pass the vibration into the contact bones of the skull into the Cochlea by uniform condition, which further pass through the inner ear to the brain, where the vibrations are interpreted into sound.

Figure 7:
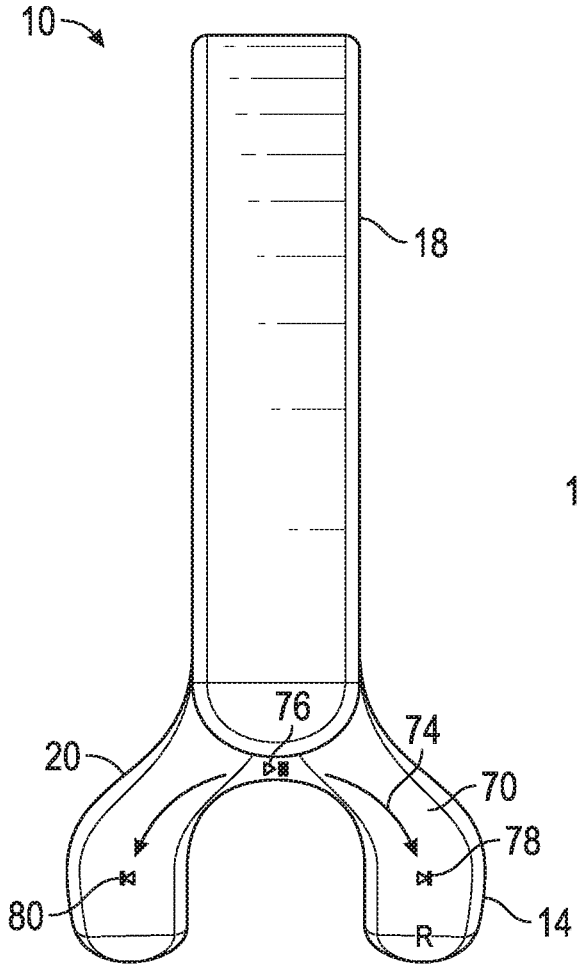
FIG. 7 is right side elevation view of the bone conduction headset.
Figure 8:
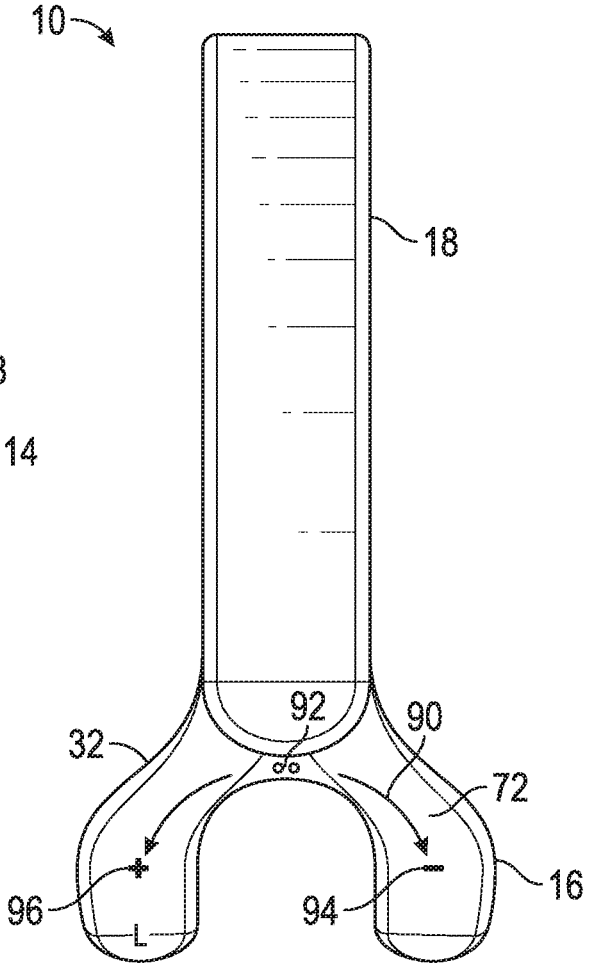
FIG. 8 is a left side elevation view of the bone conduction headset.

As shown in FIGS. 7 and 8, each first and second earpiece 14 and 16 may include a first and second touch screen panel 70 and 72, respectively. The first touch screen panel 72 may include dial 74, a first control feature 76, a second control feature 78, and a third control feature 80. The dial 74 may generally be used for controlling audio tracks and phone calls. The first control feature 76 may be touched by the user 13 to play and pause audio tracks as well as to answer and end phone calls. The second control feature 78 may be touched by the user 13 to fast forward audio or skip to another audio track or phone message. Alternatively, the user 13 may slide the dial 74 from the first control feature 76 towards the second control feature 78 to fast forward audio or skip to another audio track or phone message. Similarly, the third control feature 80 may be touched by the user 13 to rewind audio tracks or messages or skip to a previous audio track or message. Alternatively, the user 13 may slide the dial 74 from the first control feature 76 towards the third control feature 78 to perform the same task.

The second touch screen panel 72 may include dial 90, a fourth control feature 92, a fifth control feature 94, and a sixth control feature 96. The dial 90 may generally be used for controlling volume of audio received by the headset 10. The fourth control feature 92 may be touched by the user to mute audio. The fifth control feature 94 may be touched by the user 13 to decrease volume. Alternatively, the user 13 may slide the dial 90 from the fourth control feature 92 towards the fifth control feature 94 to decrease volume. Similarly, the sixth control feature 96 may be touched by the user 13 to increase volume. Alternatively, the user 13 may slide the dial 90 from the fourth control feature 92 towards the sixth control feature 96 perform the same task. One having ordinary skill in the art should appreciate that a wide variety of features and functionality may be implemented by the control features including, but not limited to, voice control, programmable multi-function buttons (MFBs), or dedicated hardware buttons.

As shown in FIGS. 3 and 4, the headset 10 may include a tongue 110 extending from each end of the headband 18. The tongue 110 is shown fully retracted in a headband housing 112 of headband 18. It should be appreciated the tongue 110 may extend further from the headband 112 to adjust the to the size of the head 12 of the user 13. The tongue 110 may be a housing for functional components of the headset 10. Such functional components may include, but are not limited to, batteries, circuitry, wiring, and audio elements, such as transducers.

The headset 10 may be charged by any known means in the art including, but not limited to, near field communication (NFC) or magnetic USB. The headband 18 may house an insulated wiring for connecting batteries and volume and Bluetooth input. In addition to housing the audio elements 22, 24, 34, and 36, the first and second housings 20 and 32 may house a variety of functional features including, but not limited to input controls as well as mic, Bluetooth, battery, audio, onboard flash storage for music playlist or on-the-go voice notes and power and function circuitry. One having ordinary skill in the art should appreciate that the above-mentioned circuitry and features may be designed in a variety of ways without departing from the inventive concepts.

Figure 9:
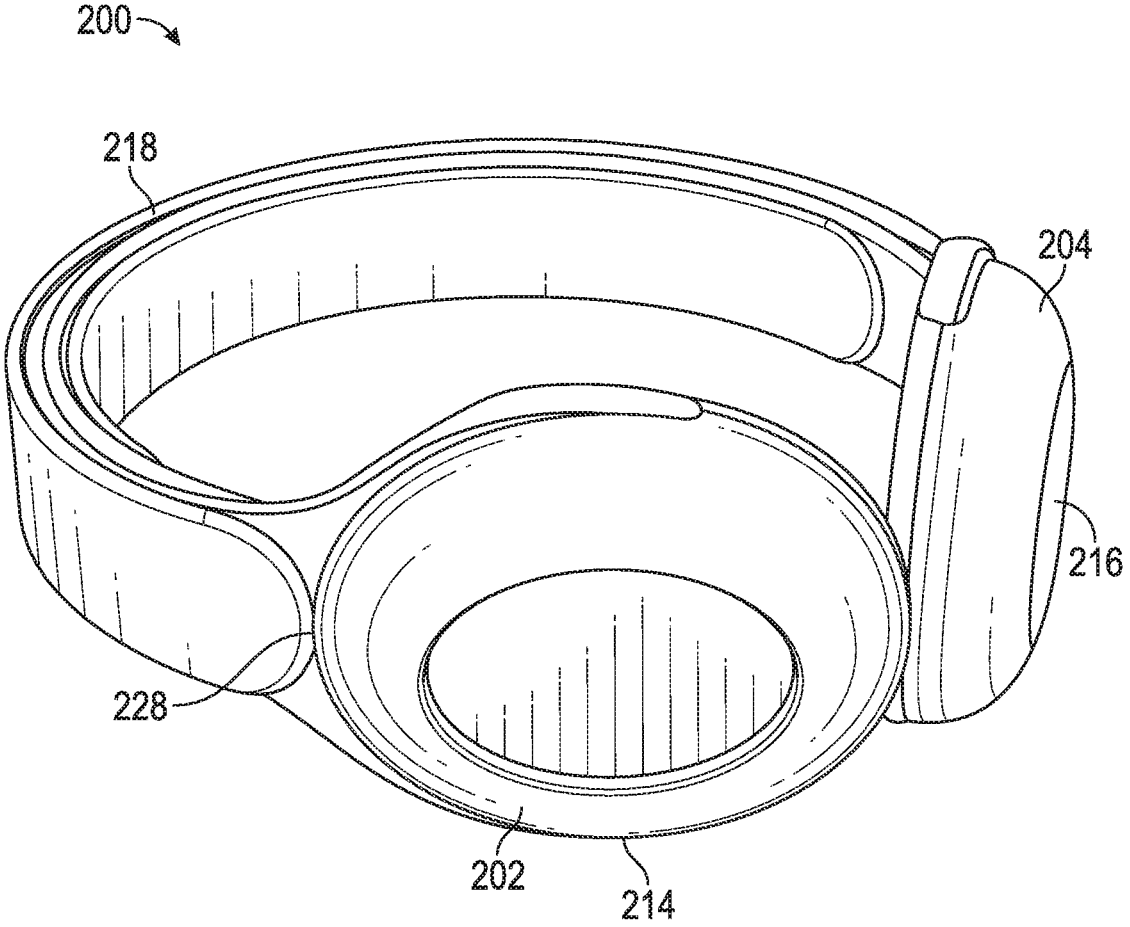
FIG. 9 is a bottom perspective view of another embodiment of a bone conduction headset.
Figure 10:
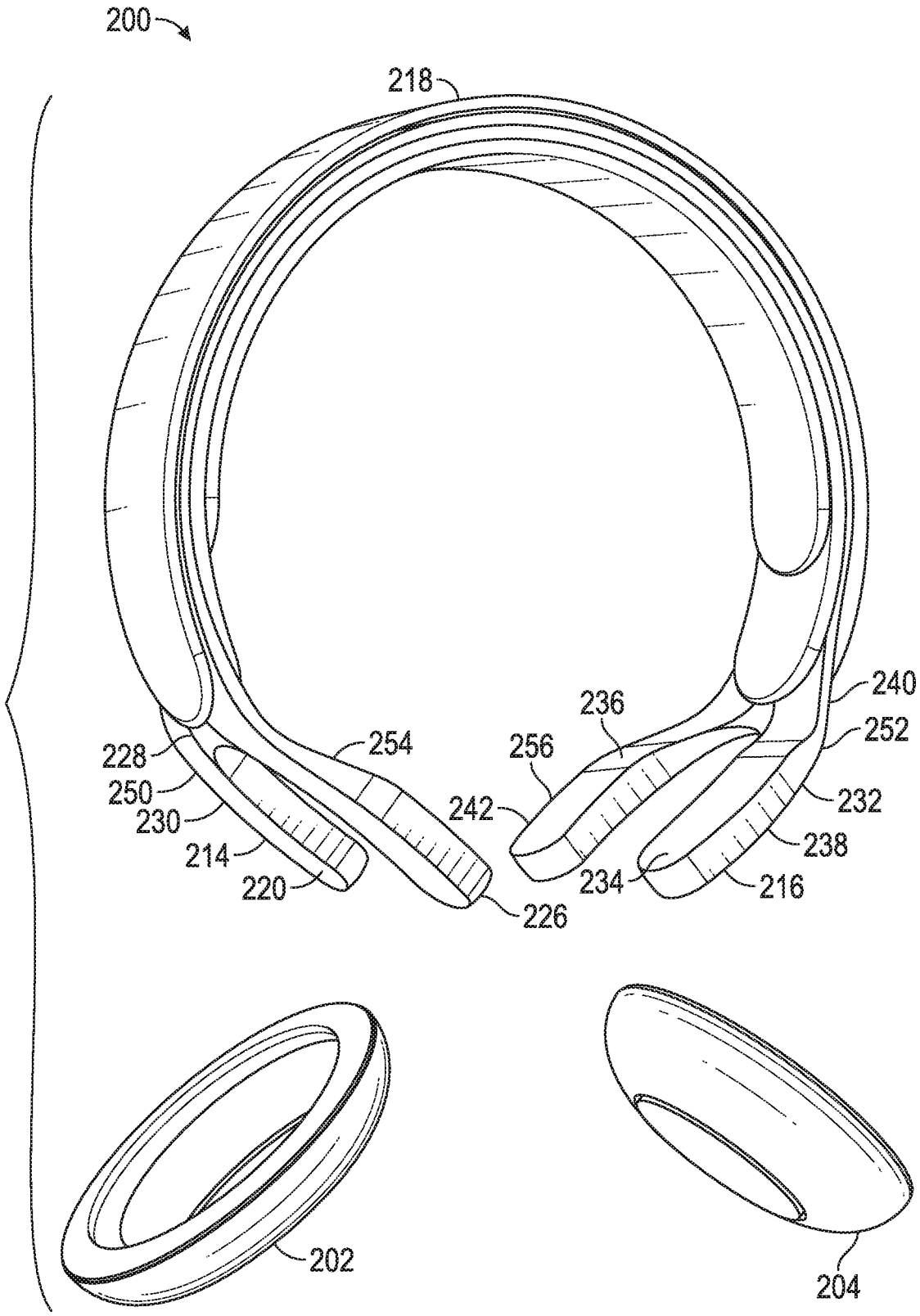
FIG. 10 is an exploded view of the bone conduction headset of FIG. 9.
Figure 11:
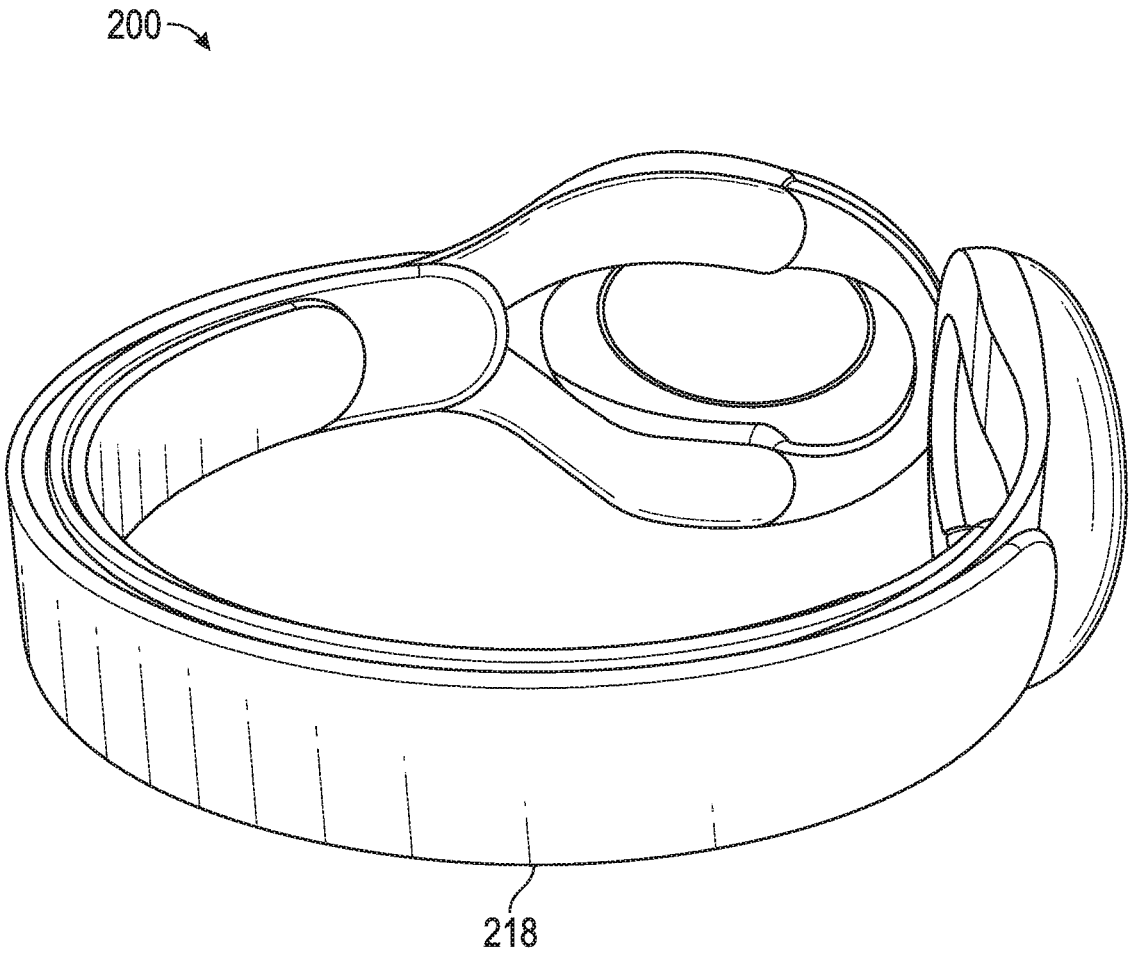
FIG. 11 is a top perspective view of the bone conduction headset of FIG. 9.

FIGS. 9-11 show another embodiment headset, namely a headset 200. The headset 200 is constructed substantially similar to the headset 10 except that the headset 200 includes a first cap 202 and a second cap 204. Like the headset 10, the headset 200 includes a first earpiece 214, a second earpiece 216, and a headband 18 extending between a crest 228 of the first earpiece 214 and a crest 240 the second earpiece 216. The first earpiece 214 includes a horseshoe shaped housing 220, a first audio element (not shown), and a second audio element (not shown). The housing 220 has a front portion 226, the crest 228, and a rear portion 230. The first audio element is positioned in the front portion 226 of the housing 220 and the second audio element is positioned in the rear portion 230 of the housing 220. The first audio element is positionable against a first side of the head 12 of a user 13 in front of a first ear and the second audio element is positionable against the first side of the head of the user behind the first ear. In this way the horseshoe shaped housing 220 arches over the top of the first ear when the headphone set 200 is worn by the user.

However, unlike the headset 10, the user's inner ear would not be exposed to the environment and is instead covered by the caps 202 and 204. The first cap 202 is positioned on an outer surface of the first earpiece 214, and the second cap 204 is positioned on an outer surface of the second earpiece 216

The second earpiece 216 also includes a horseshoe shaped housing 232, a third audio element 234, and a fourth audio element 236. The housing 232 has a front portion 238, a crest 240, and a rear portion 242. The third audio element 234 is positioned in the front portion 238 of the housing 232 and the fourth audio element 236 is positioned in the rear portion 242 of the housing 232. The third audio element 234 is positionable against a second side of the user's head in front of a second ear, and the fourth audio element 236 is positionable against the second side of the user's head behind the second ear. The headband 218 extends between the crest 228 of the first earpiece and the crest 240 of the second earpiece 216. In this way, the headband 218 fits on the top of the user's head 218 and does not obstruct the user from placing his or her head on flat surfaces—as would be the case if the headband 218 was positioned about the back of the user's head or neck. However, it should be appreciated that some users may prefer to wear the headband 218 around the back of the neck. The headset 200 may also include additional audio elements, similar to those described with respect to the headset 10.

The caps 202 and 204 may be attached to the first and second earpiece 214 and 216, respectively, by a variety of means including, but not limited to, magnets, which may double as a fastener and a conduct of electricity to power the headset 200 and transmit and receive signals. To seat the caps 202 and 204 to the headset 200, a tongue and groove approach may be implemented. A variety of materials including but not limited to rubber, may be used to provide a seal. The caps 202 and 204 may also be attached to the first and second earpiece 214 and 216, respectively by means that include, but not are not limited to include, clips, hooks, slide & lock, twist and lock, latches, and hinges. The caps 202 and 204 may be detachable and optionally worn by the user 13 and may be swapped by the user for a variety of types of speakers, for example. The caps 202 and 204 may be formed of a variety of materials including, but not limited to polyvinyl chloride ("PVC"), polylactic acid ("PVA"), aluminum and other metals, wood, and/or other suitable materials known in the art.

The caps 202 and 204 may include a wide variety of functionality including, but not limited to, noise isolation, global positioning system ("GPS"), Bluetooth pairing for mobile devices, calls, and other Bluetooth pairing technologies. By way of example, but not by way of limitation, the caps 202 and 204 may include acoustic features with isolation, dynamic (air conduction) speakers or noise cancelling features with isolation, dynamic speakers, noise cancellation, and even environmental audio pass-through. By way of example, but not by way of limitation, the caps 202 and 204 may provide a seal to the user's head to isolate environmental noise, prevent sound leakage, and create visual appeal. The caps 202 and 204 may be positioned in a way that does not inhibit contact between the audio elements and the head of the user, which could dampen vibrational transfer.

Figure 12:
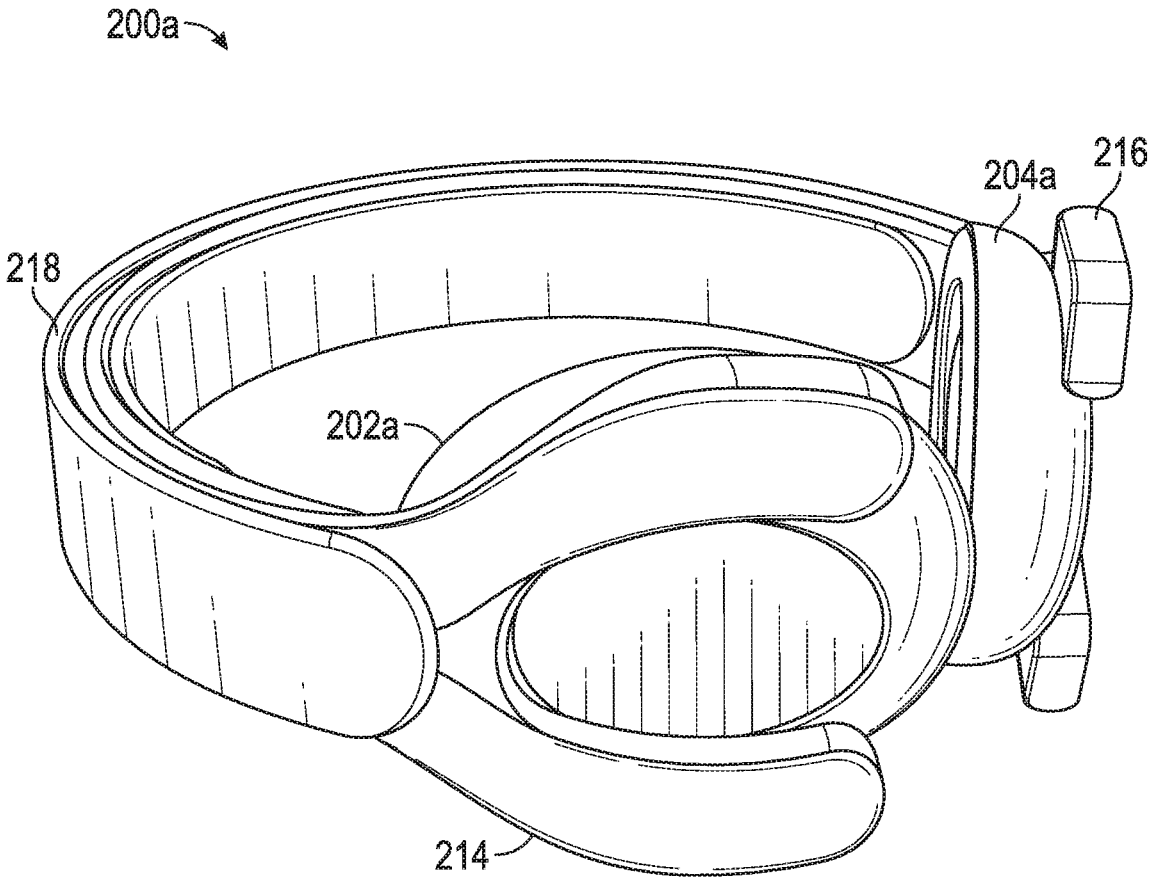
FIG. 12 is a bottom perspective view of another embodiment of a bone conduction headset.
Figure 13:
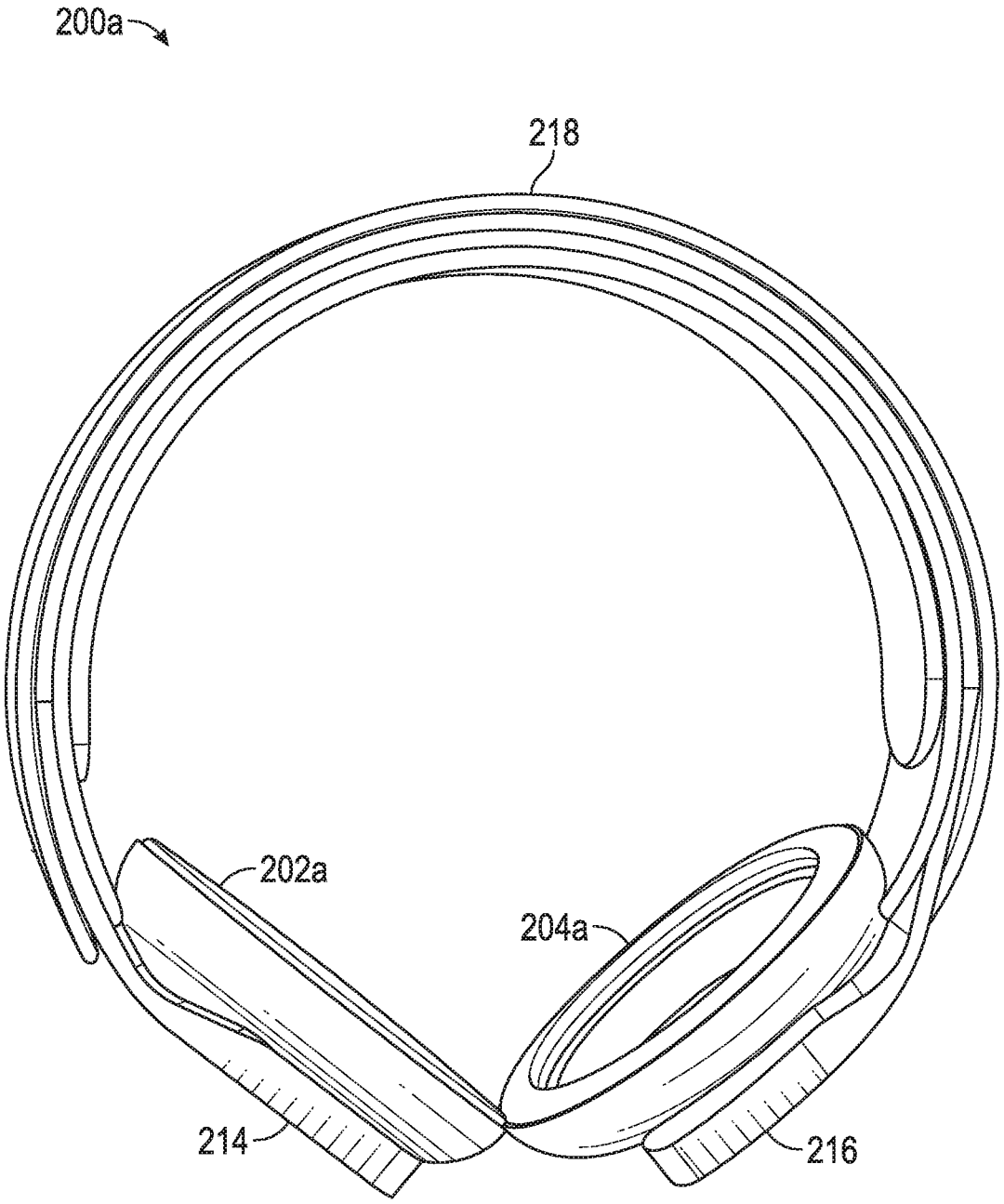
FIG. 13 is a front perspective view of another embodiment of the bone conduction headset of FIG. 12.

FIGS. 12 and 13 show another embodiment of a headset, namely a headset 200*a*. In this embodiment, a cap 202*a* may be positioned on the inner surface 254 of the first earpiece 214, and a cap 204*a* may be positioned on the inner surface 256 of the second earpiece 216. By placing the caps 202*a* and 204*a* on the inner surfaces 254 and 256, respectively, the amount of pressure against the user's head may be increase to more effectively seal the user's ear from environmental noise and prevent sound leakage. (The inner surfaces 254 and 256 are shown in FIG. 10). The attachment position of the caps 202*a* and 204*a* as shown in FIGS. 12 and 13 may also allow for traditional cushioning material to be placed against the user's head.

Figure 14:
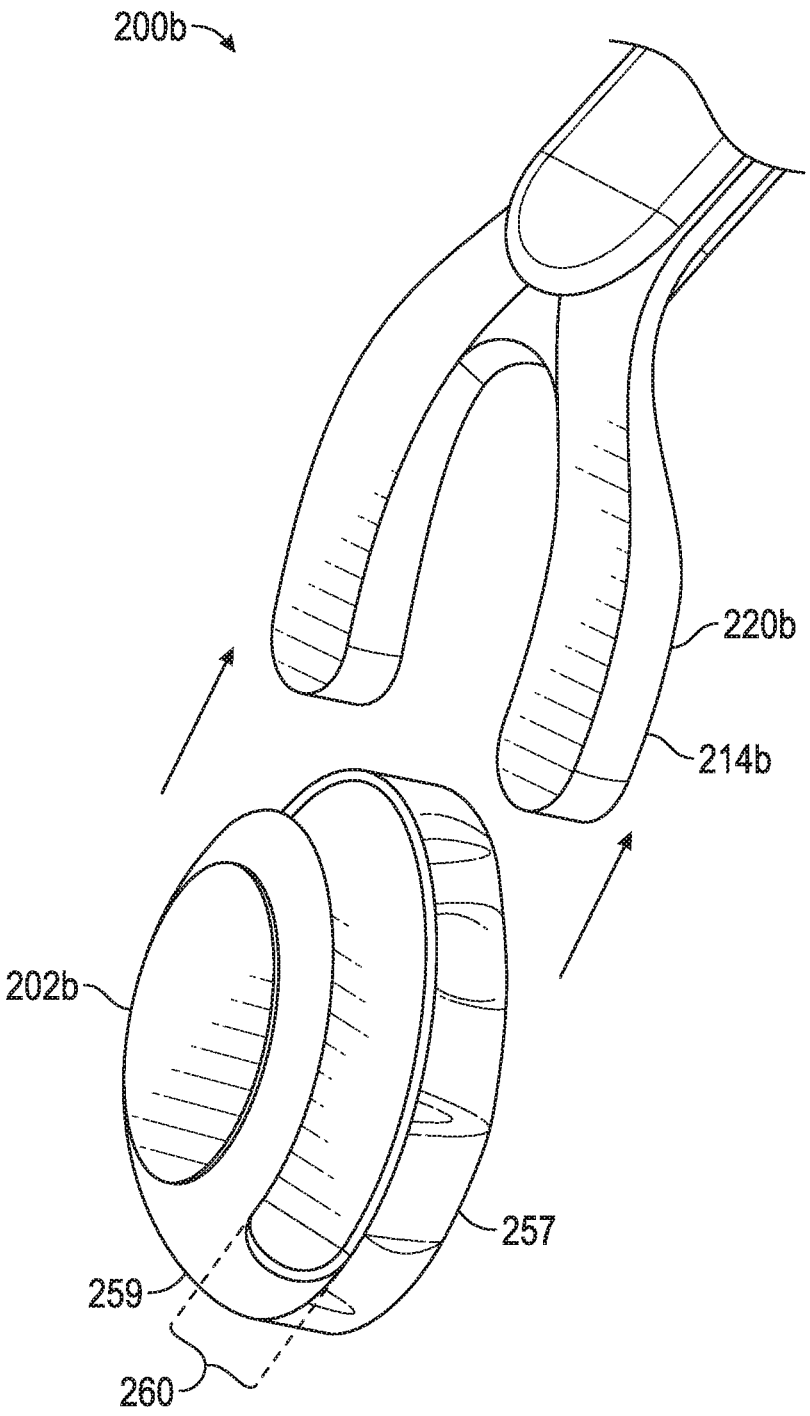
FIG. 14 is a perspective exploded view of a portion of another embodiment of a bone conduction headset.
Figure 15:
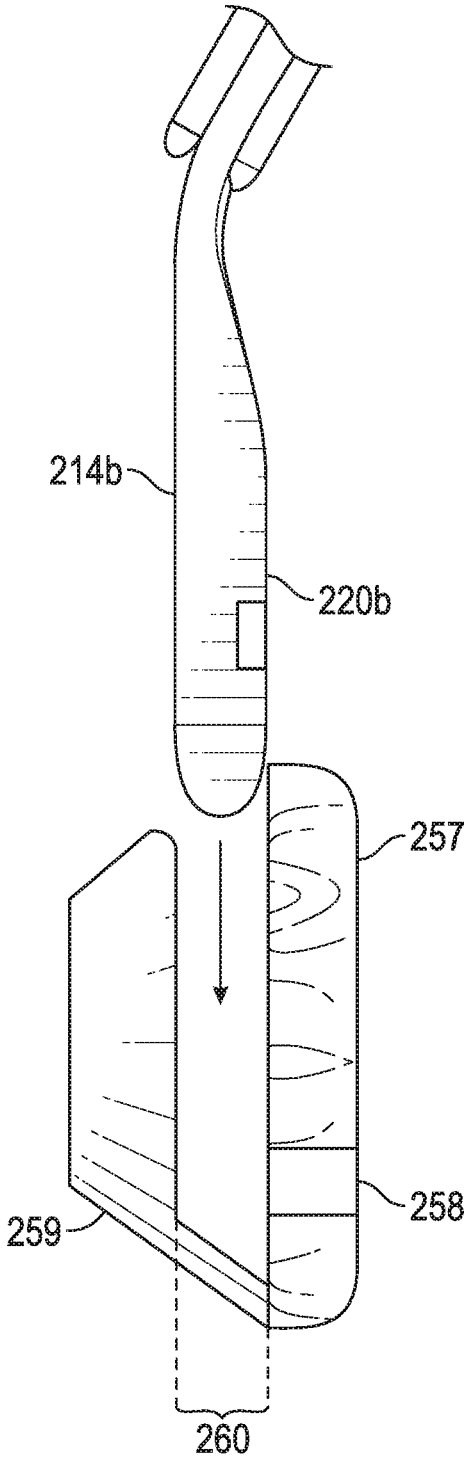
FIG. 15 is a front exploded view of the bone conduction headset of FIG. 14.
Figure 16:
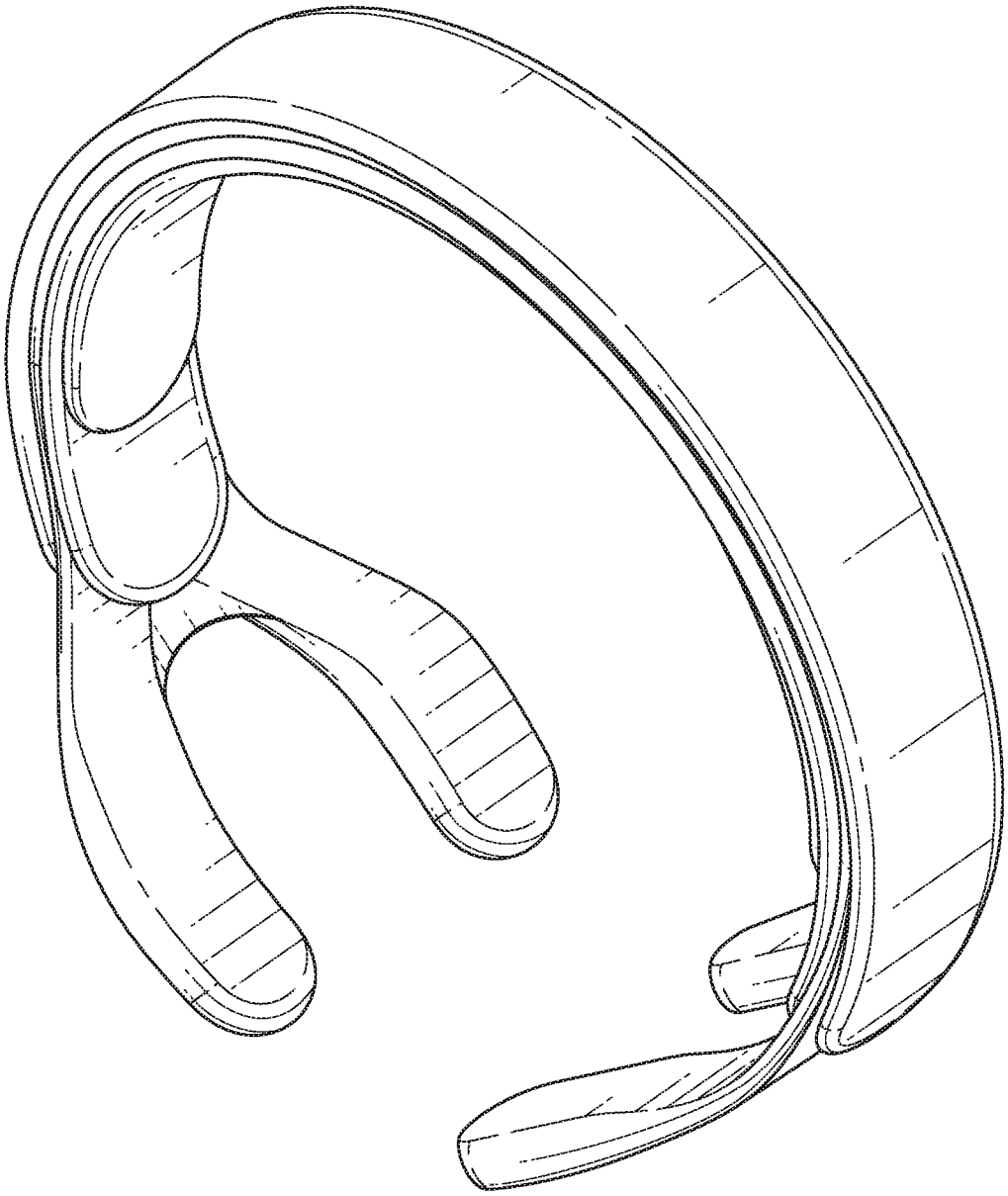
FIG. 16 is a perspective view of another embodiment of a bone conduction headset.
Figure 17:
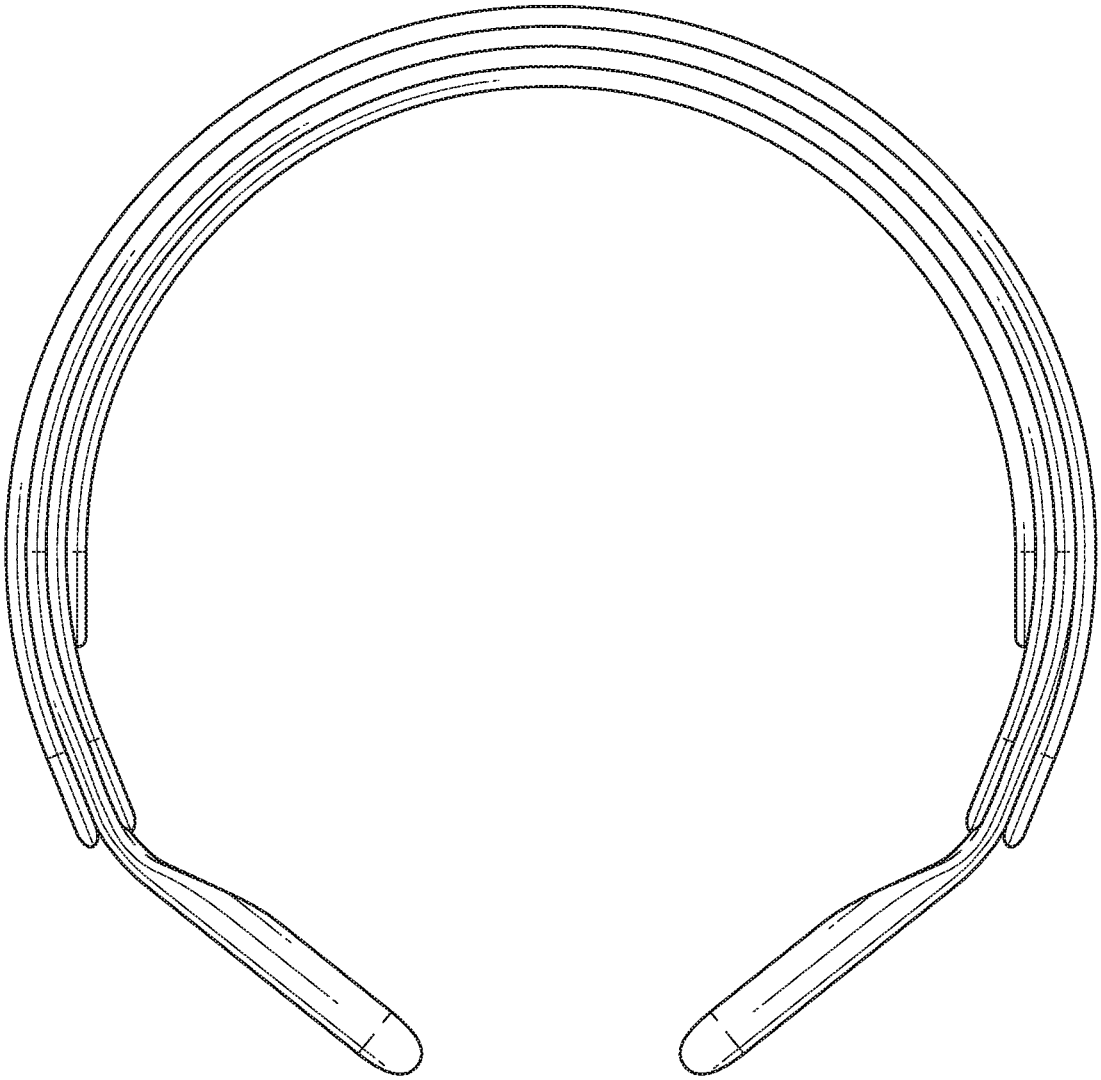
FIG. 17 is a front elevation view thereof.
Figure 18:
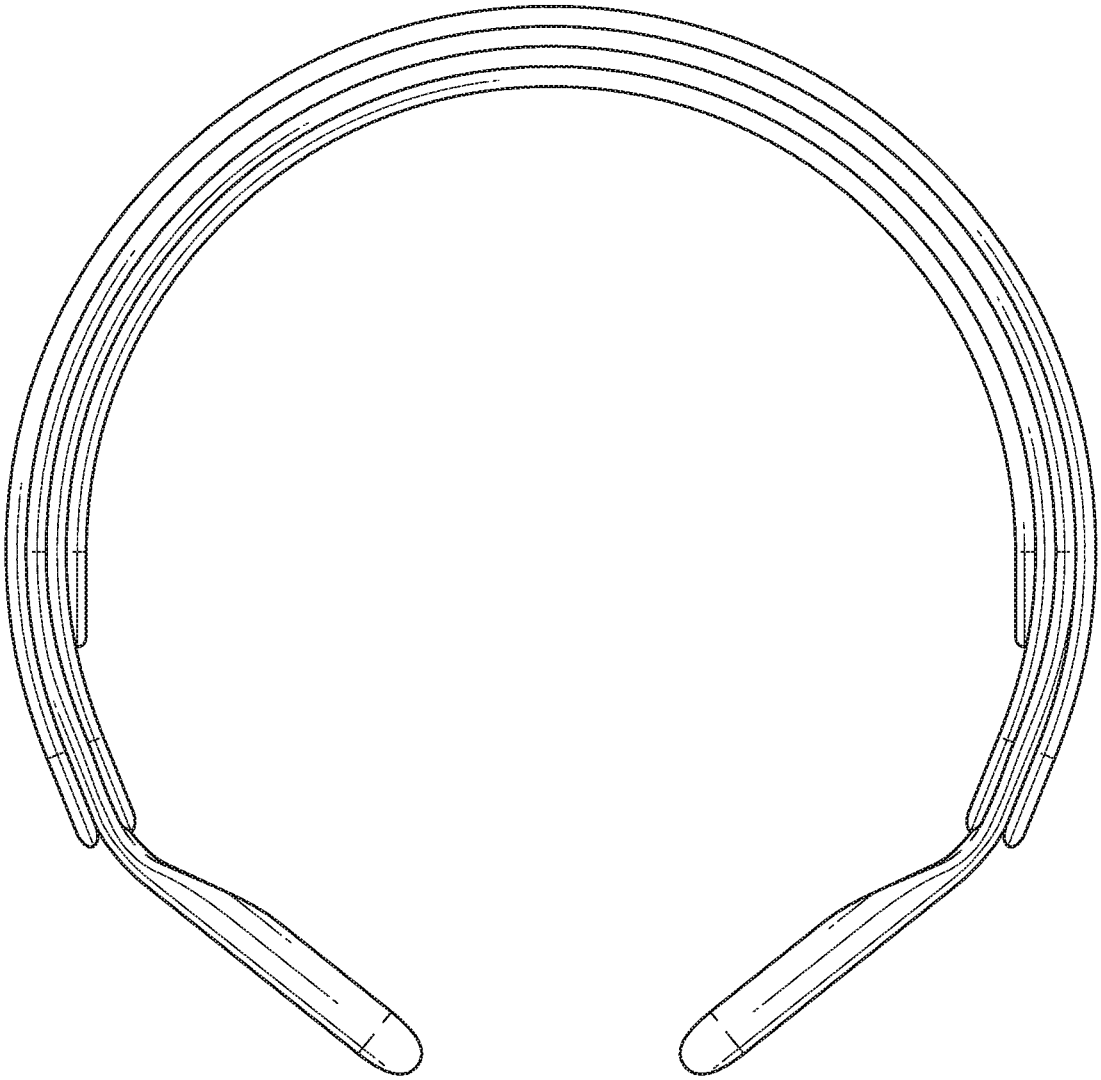
FIG. 18 is a rear elevation view thereof.
Figure 19:
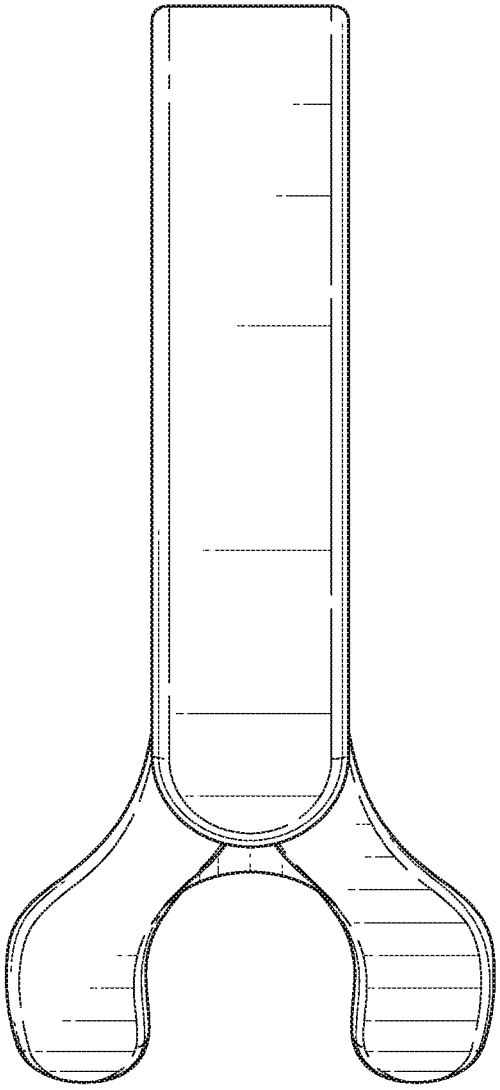
FIG. 19 is a right side elevation view thereof.
Figure 20:
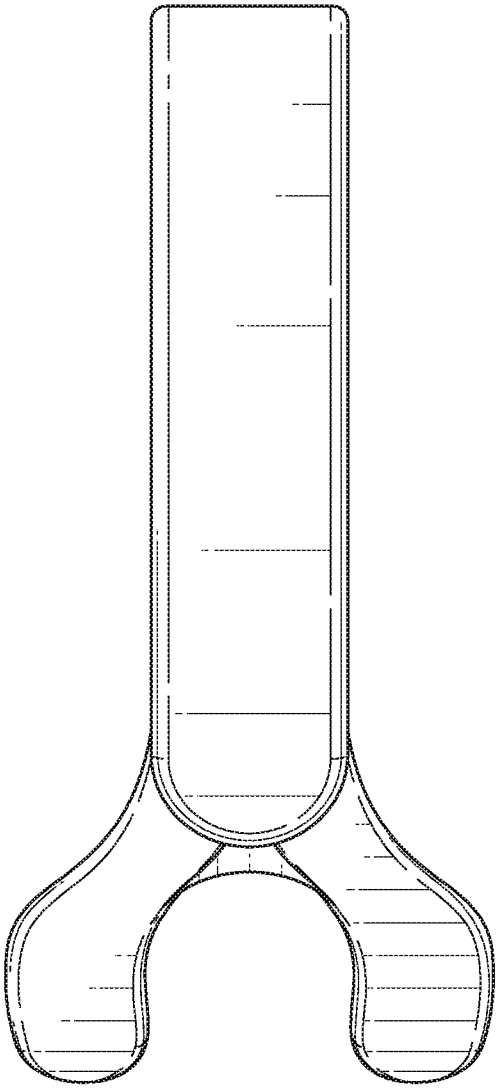
FIG. 20 is a left side elevation view thereof.
Figure 21:
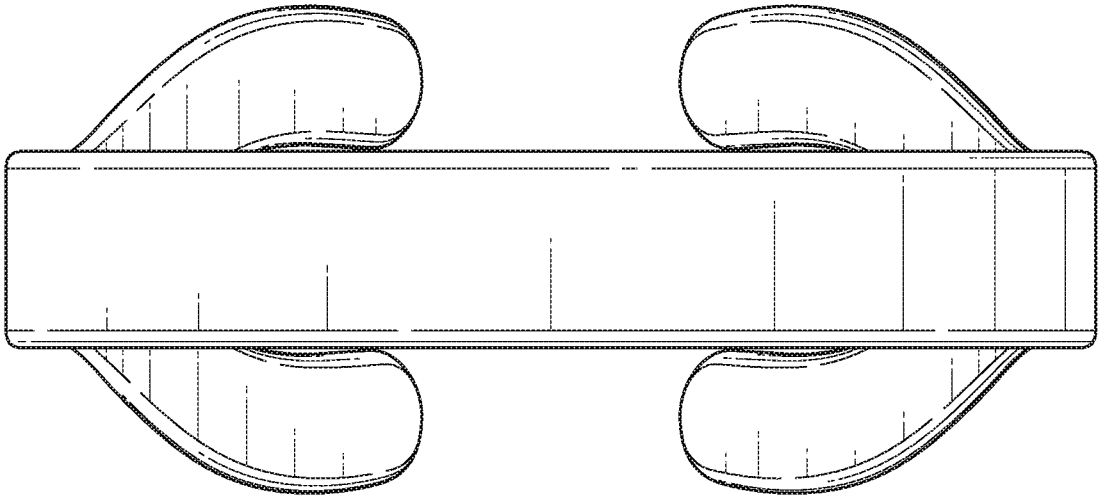
FIG. 21 is a top plan view thereof.
Figure 22:
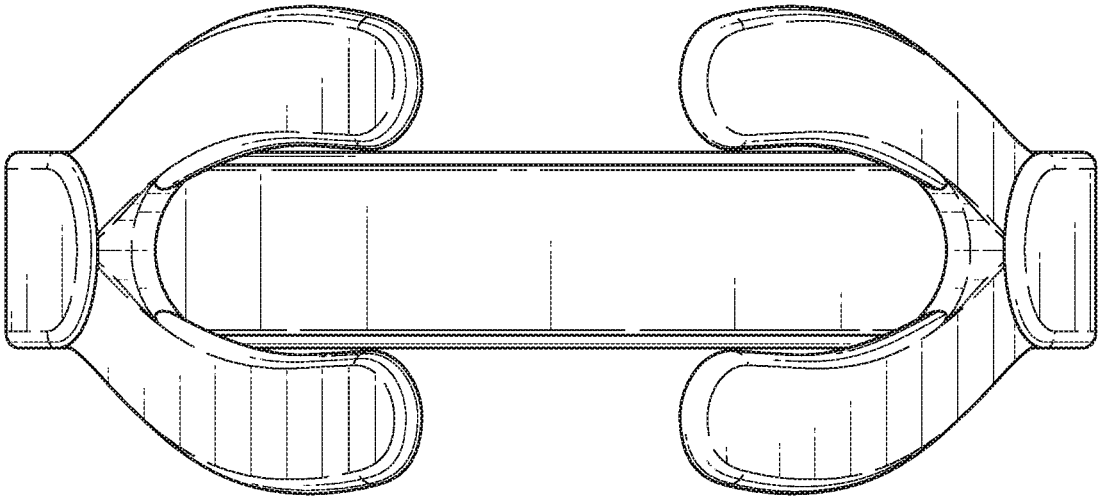
FIG. 22 is a bottom plan view thereof.
Figure 23:
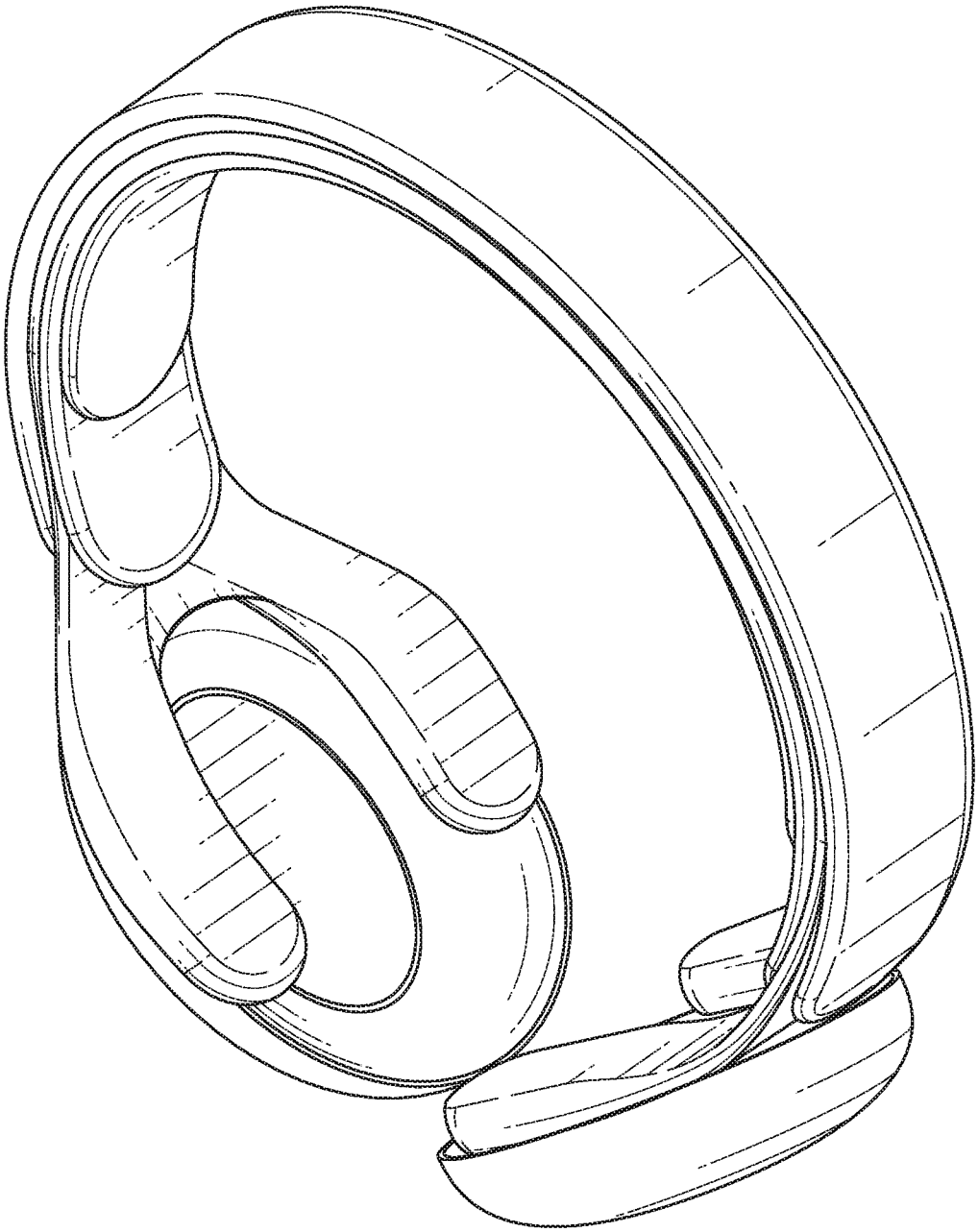
FIG. 23 is a perspective view of another embodiment of a bone conduction headset.
Figure 24:
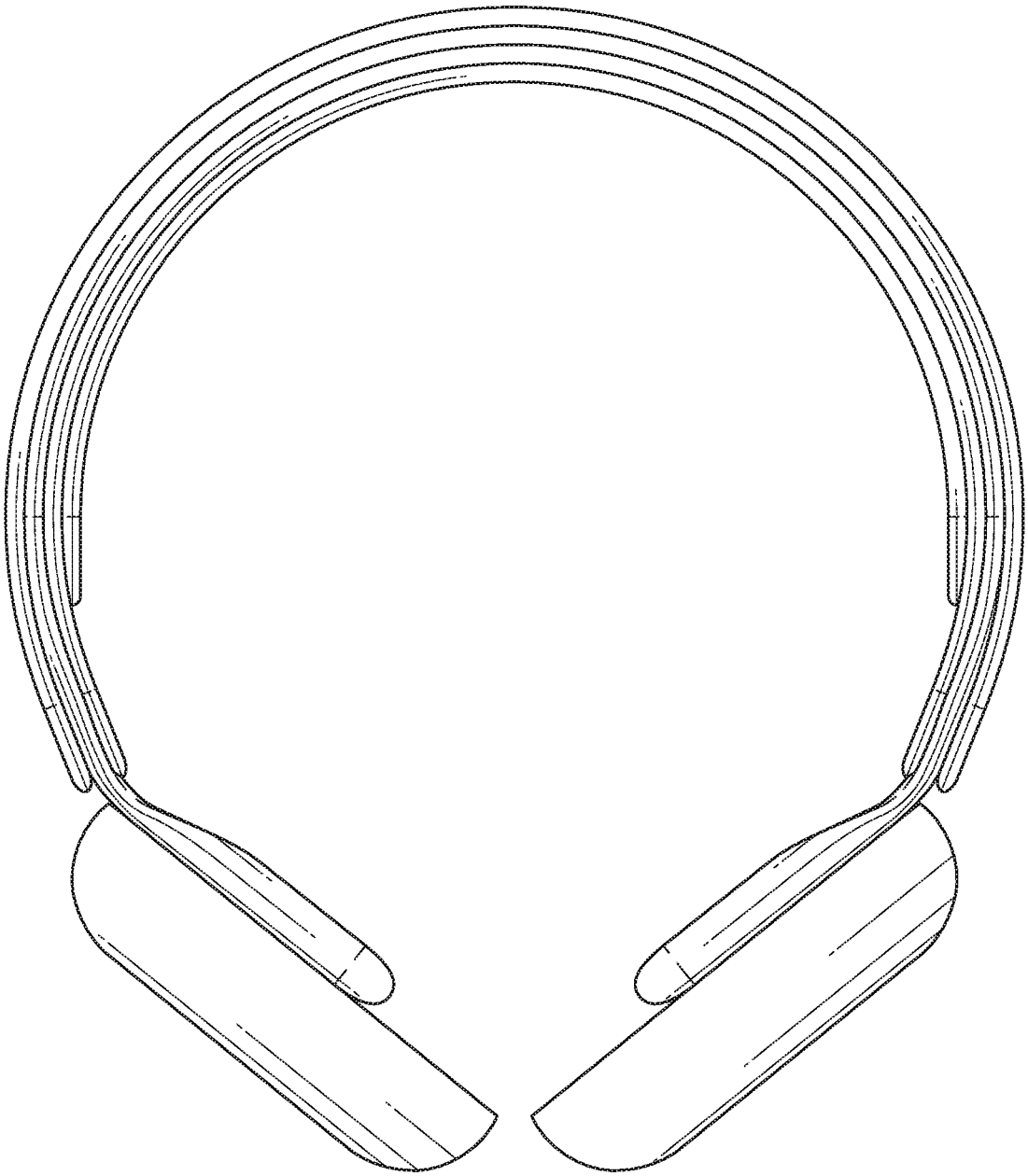
FIG. 24 is a front elevation view thereof.
Figure 25:
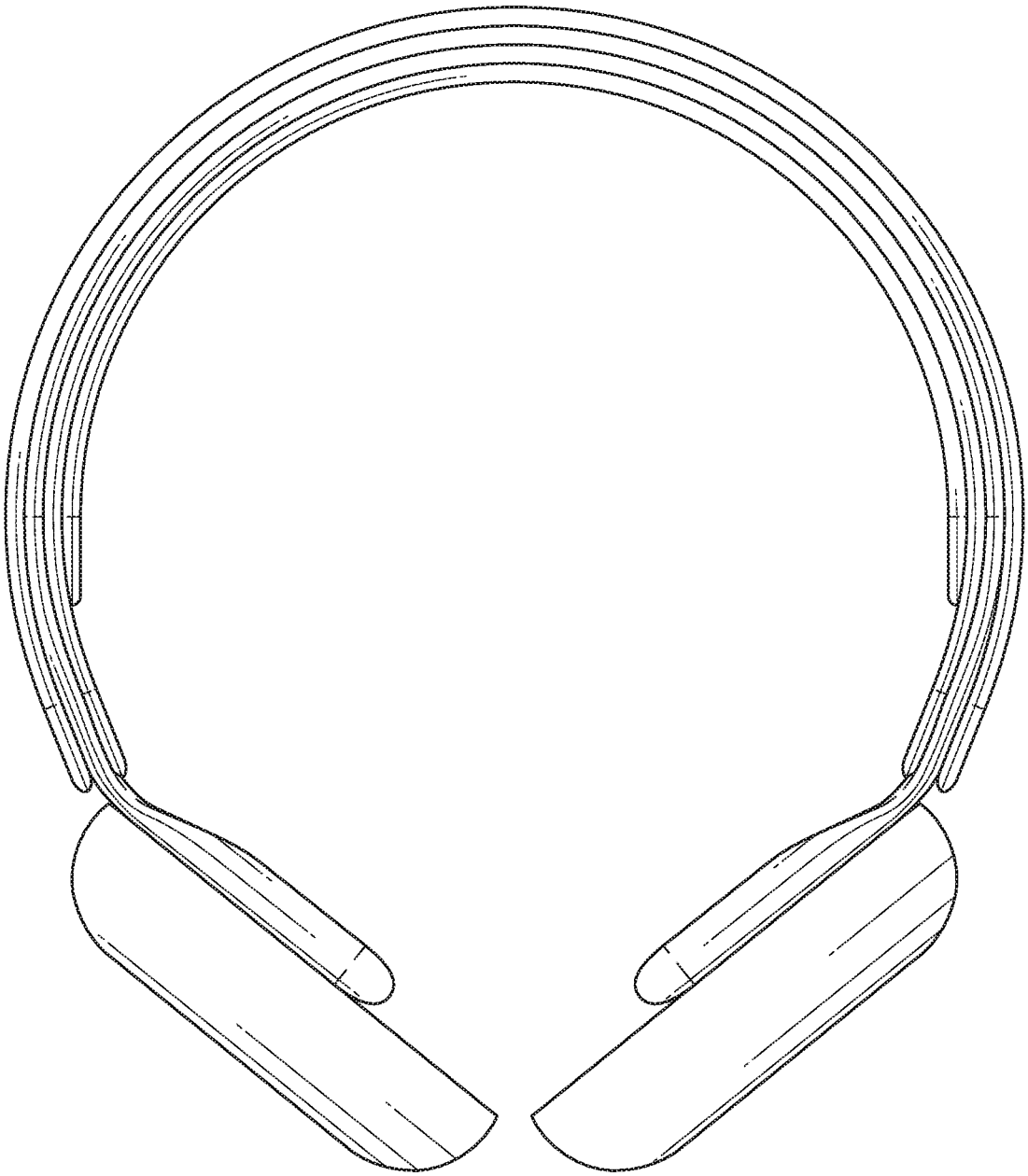
FIG. 25 is a rear elevation view thereof.
Figure 26:
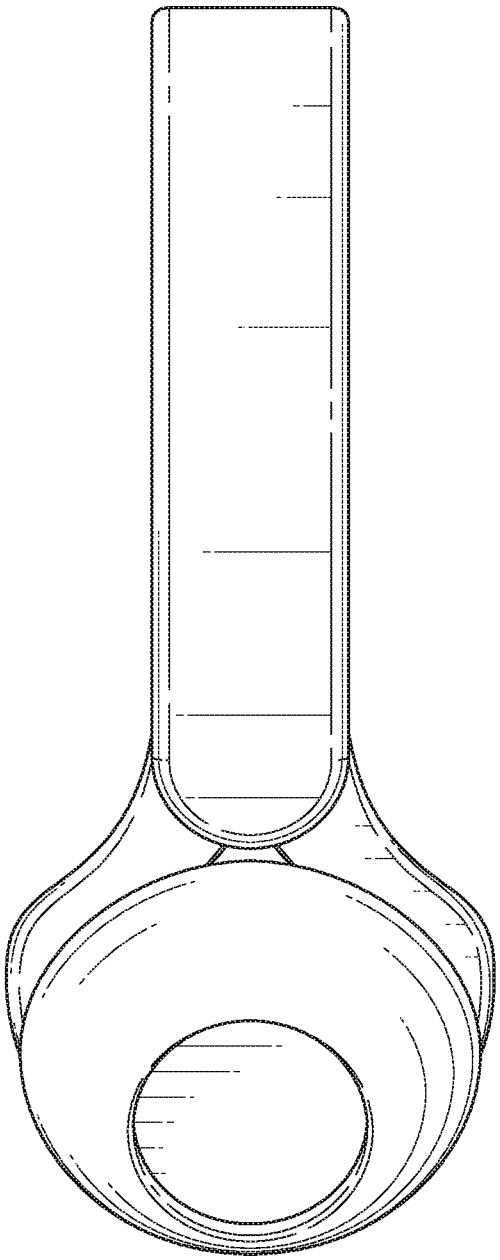
FIG. 26 is a right side elevation view thereof.
Figure 27:
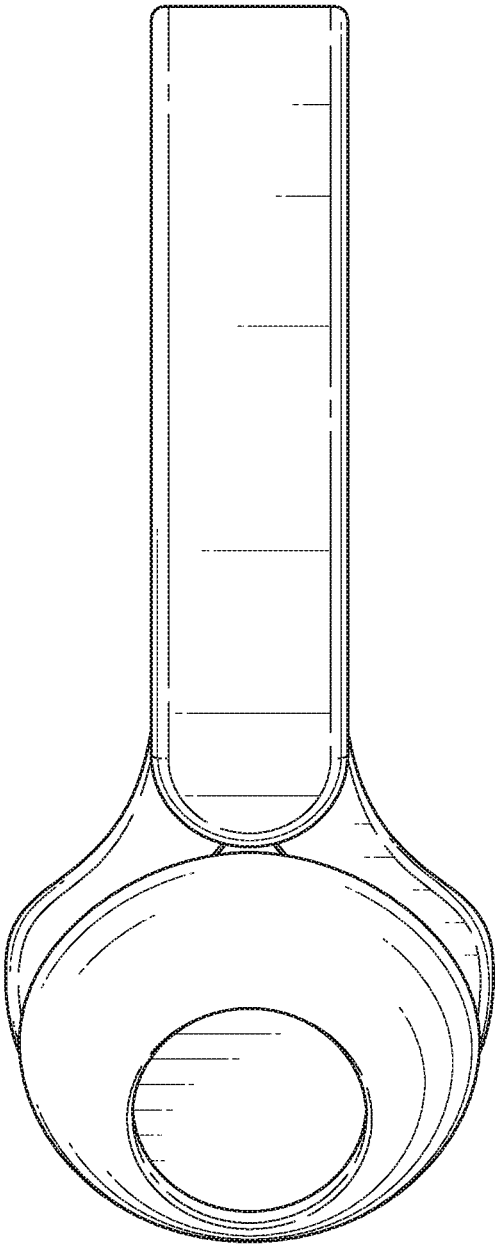
FIG. 27 is a left side elevation view thereof.
Figure 28:
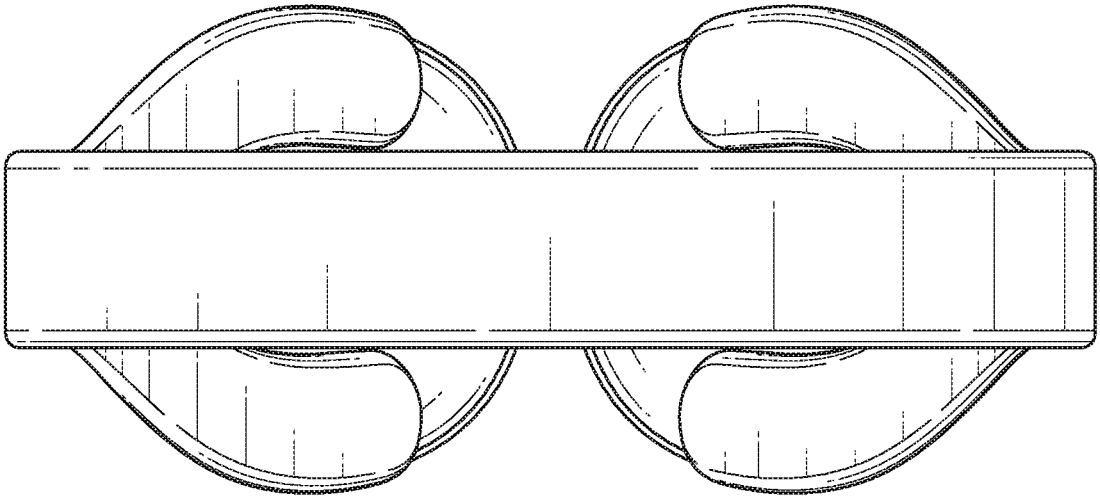
FIG. 28 is a top plan view thereof.
Figure 29:
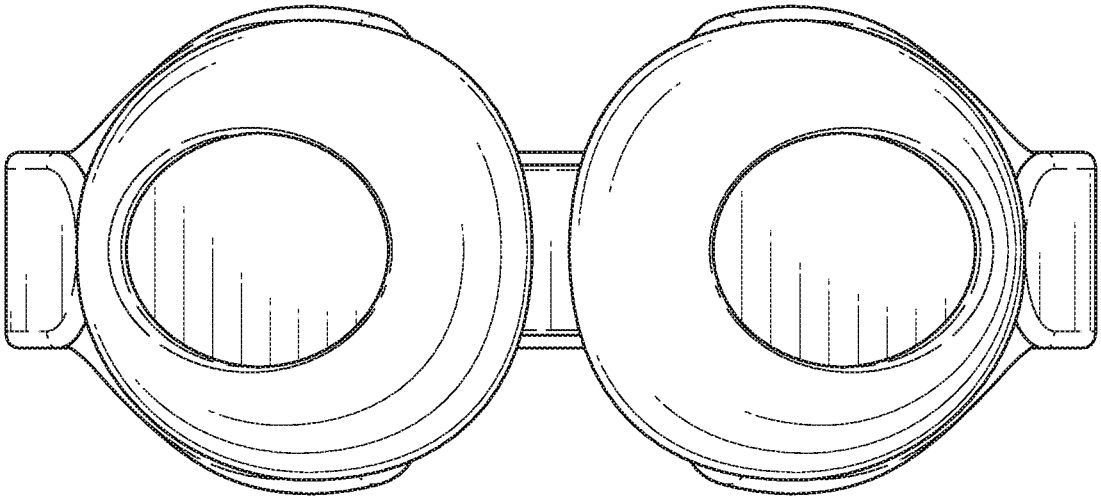
FIG. 29 is a bottom plan view thereof.
Figure 30:
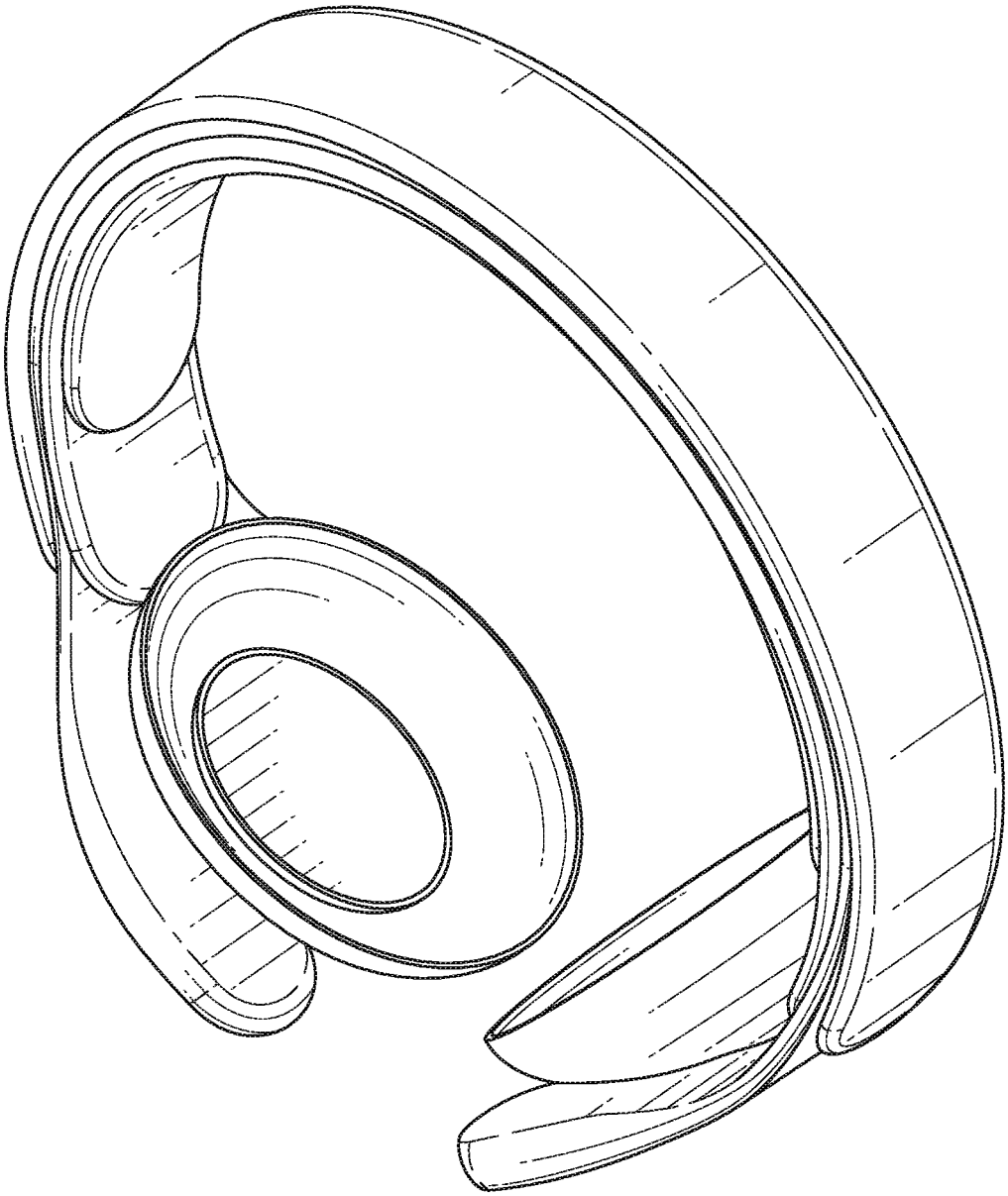
FIG. 30 is a perspective view of another embodiment of a bone conduction headset.
Figure 31:
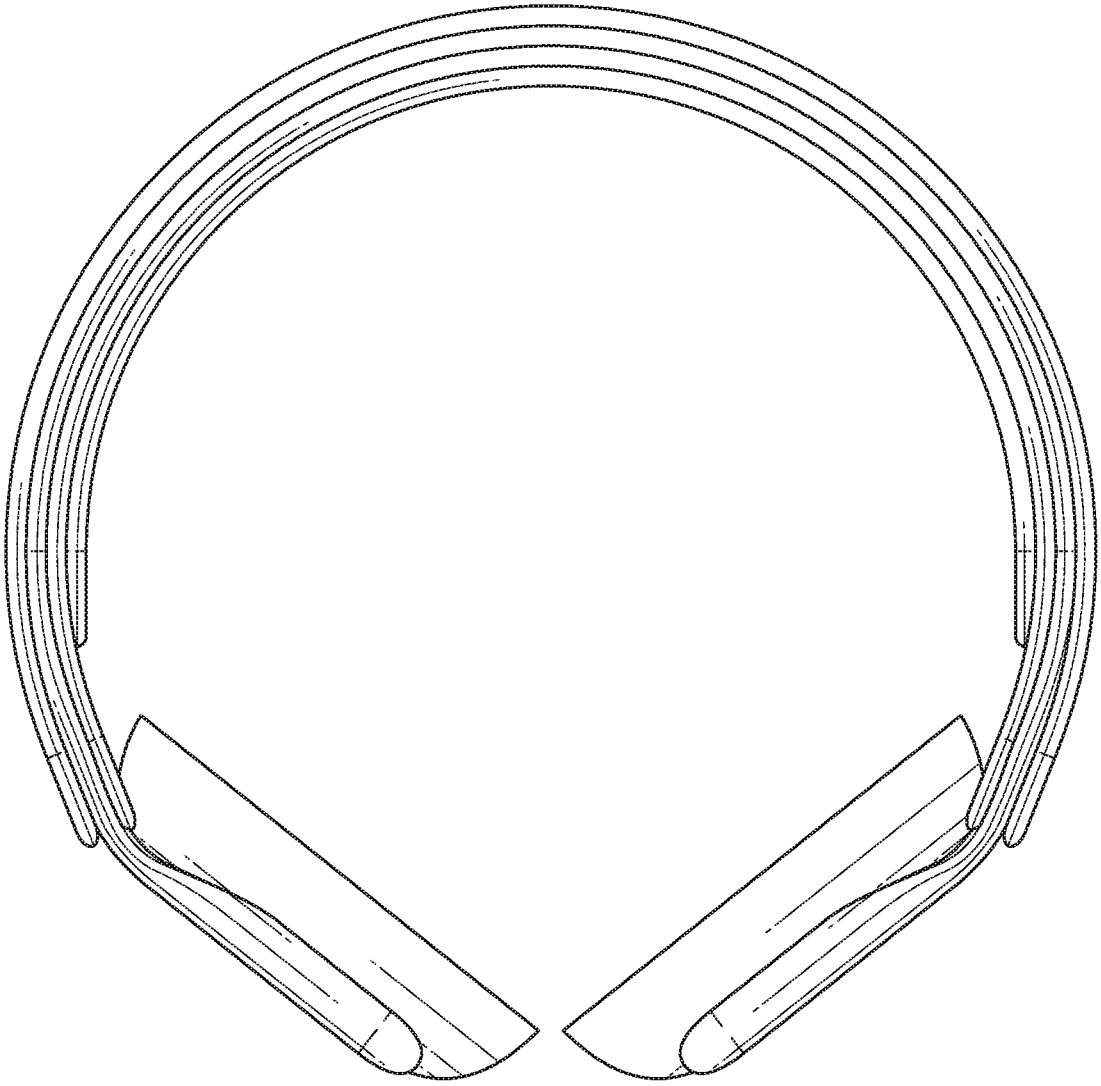
FIG. 31 is a front elevation view thereof.
Figure 32:
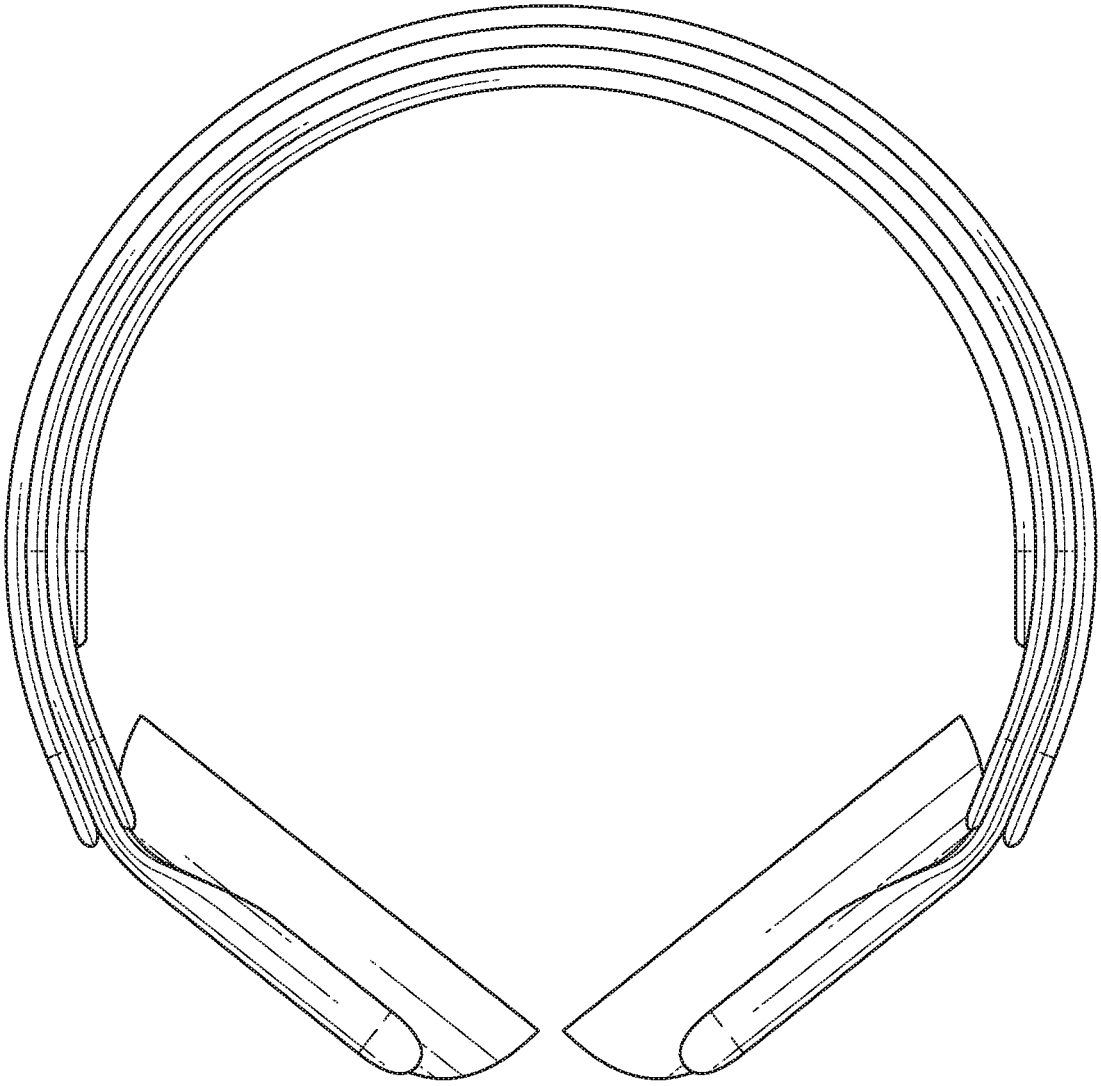
FIG. 32 is a rear elevation view thereof.
Figure 33:
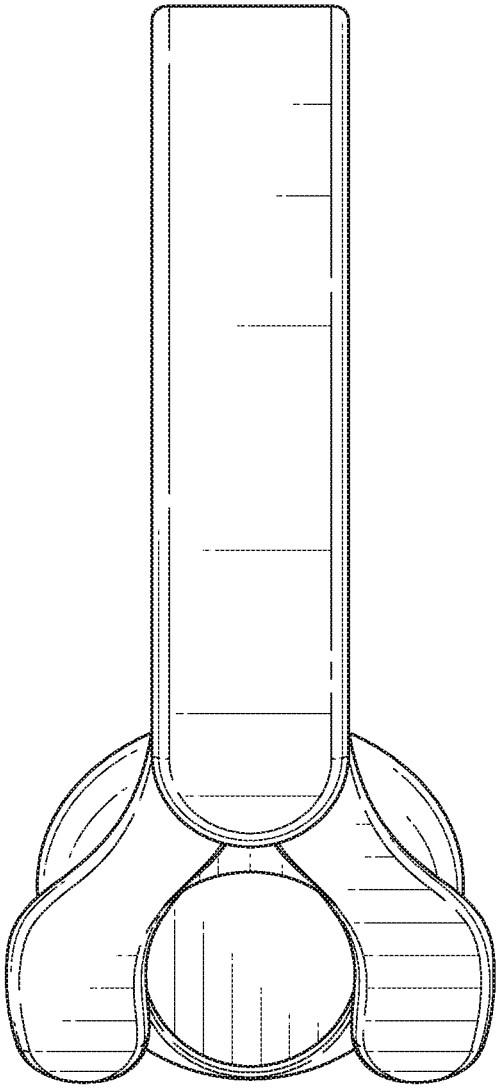
FIG. 33 is a right side elevation view thereof.
Figure 34:
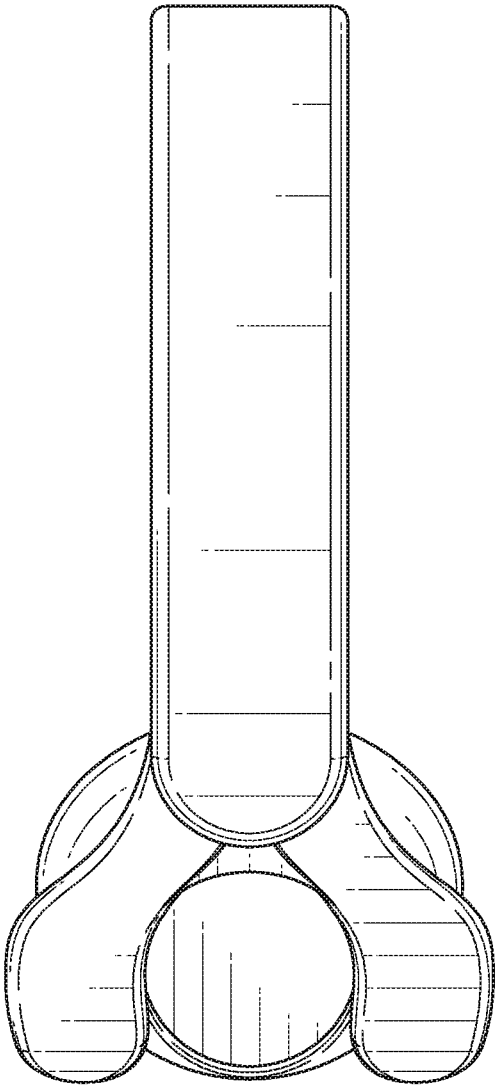
FIG. 34 is a left side elevation view thereof.
Figure 35:
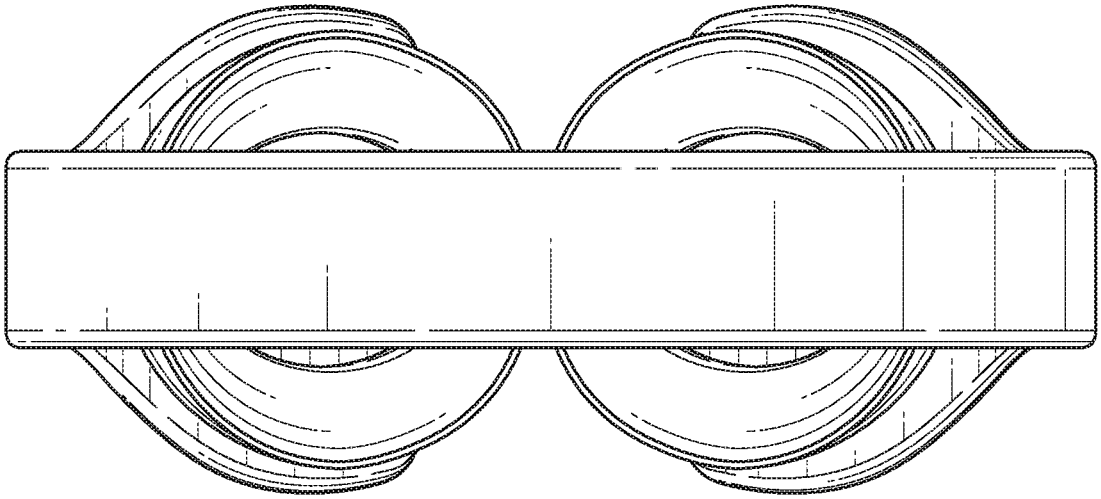
FIG. 35 is a top plan view thereof.
Figure 36:
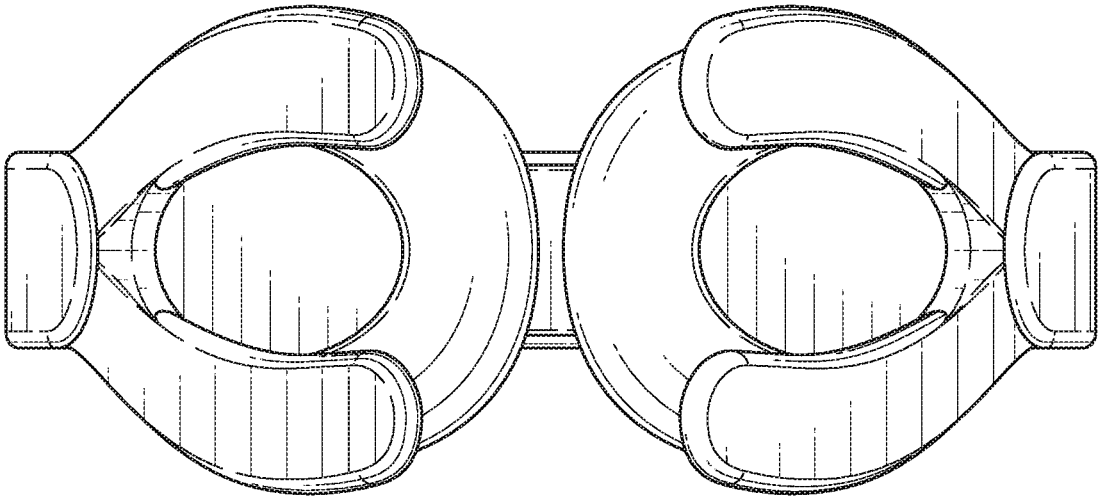
FIG. 36 is a bottom plan view thereof.

FIGS. 14 and 15 show another embodiment of a headset, namely headset 200*b*. The headset 200*b* is formed substantially similar to the headsets 200 and 200*a* except for the differences described herein. As shown in FIGS. 14 and 15, a cap 202*b* includes an inner portion 257, an outer portion 259, and a bridge 260 extending between the inner portion 257 and the outer portion 259. A housing 220*b* of an earpiece 214*b* by may be slid between the inner portion 257 and the outer portion 259. In this way, the cap 202*b* sandwiches the housing 220*b*. Sandwiching the housing 220*b* between the inner portion 257 and the outer portion 259 of the cap 202*b* may allow for internal additional cushioning and pressure. It should be appreciated that a second cap substantially similar to the cap 202*b* may be used on a second housing of a second earpiece. Such housing and earpieces are constructed substantially similar to those described herein.

It should also be appreciated that the bridge 260, the inner portion 257, and the outer portion 259 may be constructed as a single piece or may be constructed as multiple pieces. The inner portion 257 may house internal components, such as component 258 to enhance audio delivery (output) and data gathering (input). Those of ordinary skill in the art would appreciate the circuitry required to pass an output (e.g. audio, vibration, etc.) transmitted by an audio element of the housing 220*b* or the cap 202*b* to a side of the head 12. Similarly, component 258 may be used to gather wearer or environmental data (input) and transmit such data back to a destination (hardware or application) to do one or a combination of the following: store, process, and/or respond with a desired action (output). The bridge 260 may also house circuitry or other components.

The headsets 10, 200, 200*a*, and 200*b* may include additional features including, but not limited to an onboard flash drive multipurpose storage, an MP3 storage for playlist playback, a voice recording for on-the-go note taking and logs, a boom mic, an extended battery, augmented reality features, virtual reality features, mobile features, a global positioning system ("GPS"), an accelerometer, and a waterproofing feature.

The inventive concepts disclosed are further directed to a kit for forming a headphone. The kit includes the headset 200, the first cap 202, and the second cap 204. The headset 200 includes the first earpiece 214, the second earpiece 216, and the headband 218. The first earpiece 214 has a horseshoe shaped housing 220 having and a plurality of audio elements. The housing of the first earpiece has a crest 228. The second earpiece 216 has a horseshoe shaped housing 232 and a plurality of audio elements. The housing of the second earpiece has a crest 240. The headband 218 extends between the crest 228 of the first earpiece 214 and the crest 240 of the second earpiece 216. The plurality of audio elements of the first earpiece 214 are positionable against a first side of the head 12 and the plurality of audio elements of the second earpiece 216 are positionable against a second side of the head 12. The first cap 202 is attachable to the first earpiece 214, and the second cap 204 is attachable to the second earpiece 216. The first cap 202 may be attachable to an outer surface of the first earpiece 214 and the second cap 204 may attachable to an outer surface of the second earpiece 216. The first cap 202 may be attachable to an inner surface of the first earpiece 214 and the second cap 204 may be attachable to an inner surface of the second earpiece 216. The first cap 204 may be inserted between component parts of the first earpiece 214, and the second cap 206 may be inserted between component parts of the second earpiece 216.

The inventive concepts disclosed are further directed to another embodiment of a kit for forming a headphone. The kit includes a headset 200, a first cap 202, and a second cap 204. The headset includes a first earpiece 214, a second earpiece 216, and a headband 218. The first earpiece 214 has a horseshoe shaped housing 220, a first audio element, and a second audio element (not shown but constructed substantially similar to the first and second audio elements described with respect to different embodiments herein). The housing 220 has a front portion 226, a crest 228, and a rear portion 230. The first audio element is positioned in the front portion 226 of the housing 220, and the second audio element is positioned in the rear portion 230 of the housing 220. The second earpiece 216 has a horseshoe shaped housing 232, a third audio element 234, and a fourth audio element 236. The housing 232 has a front portion 238, a crest 240, and a rear portion 242. The third audio element 234 is positioned in the front portion 238 of the housing 232 and the fourth audio element 236 is positioned in the rear portion 242 of the housing 232. The first audio element is positionable against a first side 50 of the head 12 in front of a first ear 11, the second audio element is positionable against the first side 50 of the head 12 behind the first ear 11, the third audio element is positionable against a second side of the head 12 in front of a second ear 17, and the fourth audio 236 element is positionable against the second side 52 of the head behind the second ear 14. The headband 218 extends between the crest 228 of the first earpiece 214 and the crest 240 of the second earpiece 216. The first cap 202 is attachable to the first earpiece 214. The second cap 204 is attachable to the second earpiece 216. The first cap 202 may be attachable to an outer surface of the first earpiece 214 and the second cap 204 may attachable to an outer surface of the second earpiece 216. The first cap 202 may be attachable to an inner surface of the first earpiece 214 and the second cap 216 may be attachable to an inner surface of the second earpiece 216. The first cap 202 may be inserted between component parts of the first earpiece 214, and the second cap 206 may be inserted between component parts of the second earpiece 216.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and claimed herein.

The invention claimed is:

1. A headset for a head, comprising:

a first earpiece having a horseshoe shaped housing and a plurality of audio elements, the housing having a front portion, a rear portion, and a crest positioned between the front portion and the rear portion, the plurality of audio elements positioned in at least one of the front portion and the rear portion;

a second earpiece having a horseshoe shaped housing and a plurality of audio elements, the housing having a front portion, a rear portion, and a crest positioned between the front portion and the rear portion, the plurality of audio elements position in at least one of the front portion and the rear portion;

a headband extending between the crest of the first earpiece and the crest of the second earpiece, wherein the plurality of audio elements of the first earpiece are positionable against a first side of the head and the plurality of audio elements of the second earpiece are positionable against a second side of the head.

2. The headset of claim 1, further comprising:

a first cap attached to the first earpiece; and a second cap attached to the second earpiece.

3. The headset of claim 2, wherein the first cap is attached to an outer surface of the first earpiece and the second cap is attached to an outer surface of the second earpiece.

4. The headset of claim 2, wherein the first cap is attached to an inner surface of the first earpiece and the second cap is attached to an inner surface of the second earpiece.

5. The headset of claim 1, further comprising:

a first cap having an inner portion, an outer portion, and a bridge extending between the inner portion and the outer portion; and a second cap having an inner portion, an outer portion, and a bridge extending between the inner portion and the outer portion, wherein the first earpiece is slidably received between the inner portion and the outer portion of the first cap, and wherein the second earpiece is slidably received between the inner portion and the outer portion of the second cap.

6. A headset for a head, comprising:

a first earpiece having a horseshoe shaped housing, a first audio element, and a second audio element, the housing having a front portion, a crest, and a rear portion, the first audio element positioned in the front portion of the housing, and the second audio element positioned in the rear portion of the housing;

a second earpiece having a horseshoe shaped housing, a third audio element, and a fourth audio element, the housing having a front portion, a crest, and a rear portion, the third audio element positioned in the front portion of the housing, and the fourth audio element positioned in the rear portion of the housing; and a headband extending between the crest of the first earpiece and the crest of the second earpiece, wherein the first audio element is positionable against a first side of the head in front of a first ear, the second audio element is positionable against the first side of the head behind the first ear, the third audio element is positionable against a second side of the head in front of a second ear, and the fourth audio element is positionable against the second side of the head behind the second ear.

7. The headset for a head of claim 6, further comprising:

a first cap attached to the first earpiece; and a second cap attached to the second earpiece.

8. The headset of claim 7, wherein the first cap is attachable to an outer surface of the first earpiece and the second cap is attachable to an outer surface of the second earpiece.

9. The headset of claim 7, wherein the first cap is attachable to an inner surface of the first earpiece and the second cap is attachable to an inner surface of the second earpiece.

10. The headset of claim 6, further comprising:

a first cap having an inner portion, an outer portion, and a bridge extending between the inner portion and the outer portion; and a second cap having an inner portion, an outer portion, and a bridge extending between the inner portion and the outer portion, wherein the first earpiece is slidably received between the inner portion and the outer portion of the first cap, and wherein the second earpiece is slidably received between the inner portion and the outer portion of the second cap.

11. A kit for forming a headphone for a head, comprising:

a headset comprising:

a first earpiece having a horseshoe shaped housing and a plurality of audio elements, the housing having a crest; a second earpiece having a horseshoe shaped housing and a plurality of audio elements, the housing having a crest; a headband extending between the crest of the first earpiece and the crest of the second earpiece, wherein the plurality of audio elements of the first earpiece are positionable against a first side of the head and the plurality of audio elements of the second earpiece are positionable against a second side of the head; a first cap attachable to the first earpiece; and a second cap attachable to the second earpiece.

12. The kit of claim 11, wherein the first cap is attachable to an outer surface of the first earpiece and the second cap is attachable to an outer surface of the second earpiece.

13. The kit of claim 11, wherein the first cap is attachable to an inner surface of the first earpiece and the second cap is attachable to an inner surface of the second earpiece.

14. A kit for forming a headphone for a head, comprising: a headset comprising:

a first earpiece having a horseshoe shaped housing, a first audio element, and a second audio element, the housing having a front portion, a crest, and a rear portion, the first audio element positioned in the front portion of the housing, and the second audio element positioned in the rear portion of the housing; a second earpiece having a horseshoe shaped housing, a third audio element, and a fourth audio element, the housing having a front portion, a crest, and a rear portion, the third audio element positioned in the front portion of the housing, and the fourth audio element positioned in the rear portion of the housing; a headband extending between the crest of the first earpiece and the crest of the second earpiece; wherein the first audio element is positionable against a first side of the head in front of a first ear, the second audio element is positionable against the first side of the head behind the first ear, the third audio element is positionable against a second side of the head in front of a second ear, and the fourth audio element is positionable against the second side of the head behind the second ear; a first cap attachable to the first earpiece; and a second cap attachable to the second earpiece.

15. The kit of claim 14, wherein the first cap is attachable to an outer surface of the first earpiece and the second cap is attachable to an outer surface of the second earpiece.

16. The kit of claim 14, wherein the first cap is attachable to an inner surface of the first earpiece and the second cap is attachable to an inner surface of the second earpiece.

17. A kit for forming a headphone for a head, comprising: a headset comprising:

a first earpiece having a horseshoe shaped housing and a plurality of audio elements, the housing having a crest; a second earpiece having a horseshoe shaped housing and a plurality of audio elements, the housing having a crest; a headband extending between the crest of the first earpiece and the crest of the second earpiece, wherein the plurality of audio elements of the first earpiece are positionable against a first side of the head and the plurality of audio elements of the second earpiece are positionable against a second side of the head; a first cap having an inner portion, an outer portion, and a bridge extending between the inner portion and the outer portion, the first earpiece slidably receivable between the inner portion and the outer portion of the first cap; and a second cap having an inner portion, an outer portion, and a bridge extending between the inner portion and the outer portion, the second earpiece slidably receivable between the inner portion and the outer portion of the second cap.

18. A kit for forming a headphone for a head, comprising: a headset comprising:

a first earpiece having a horseshoe shaped housing, a first audio element, and a second audio element, the housing having a front portion, a crest, and arear portion, the first audio element positioned in the front portion of the housing, and the second audio element positioned in the rear portion of the housing; a second earpiece having a horseshoe shaped housing, a third audio element, and a fourth audio element, the housing having a front portion, a crest, and a rear portion, the third audio element positioned in the front portion of the housing, and the fourth audio element positioned in the rear portion of the housing; a headband extending between the crest of the first earpiece and the crest of the second earpiece; wherein the first audio element is positionable against a first side of the head in front of a first ear, the second audio element is positionable against the first side of the head behind the first ear, the third audio element is positionable against a second side of the head in front of a second ear, and the fourth audio element is positionable against the second side of the head behind the second ear; a first cap having an inner portion, an outer portion, and a bridge extending between the inner portion and the outer portion, the first earpiece slidably receivable between the inner portion and the outer portion of the first cap; and a second cap having an inner portion, an outer portion, and a bridge extending between the inner portion and the outer portion, the second earpiece slidably receivable between the inner portion and the outer portion of the second cap.

* * * * *